US011676451B2

(12) United States Patent
Abrahamson

(10) Patent No.: US 11,676,451 B2
(45) Date of Patent: Jun. 13, 2023

(54) JACKPOT CHANCE FOR RANDOMLY PICKED SEAT POSITIONS AT MIXED TABLES FEATURING COMMUNITY SIDE BETS

(71) Applicant: AGS LLC, Las Vegas, NV (US)

(72) Inventor: Jamie Allan Abrahamson, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 270 days.

(21) Appl. No.: 16/992,881

(22) Filed: Aug. 13, 2020

(65) Prior Publication Data

US 2021/0065508 A1 Mar. 4, 2021

Related U.S. Application Data

(60) Provisional application No. 62/895,611, filed on Sep. 4, 2019.

(51) Int. Cl.
*G07F 17/32* (2006.01)

(52) U.S. Cl.
CPC ..... *G07F 17/3258* (2013.01); *G07F 17/322* (2013.01); *G07F 17/3272* (2013.01); *G07F 17/3288* (2013.01); *G07F 17/3293* (2013.01)

(58) Field of Classification Search
None
See application file for complete search history.

(56) References Cited

U.S. PATENT DOCUMENTS

| | | | |
|---|---|---|---|
| 5,743,800 | A | 4/1998 | Huard et al. |
| 9,662,563 | B2 | 5/2017 | Van Asdale et al. |
| 10,204,486 | B2 | 2/2019 | Van Asdale et al. |
| 10,332,348 | B2 | 6/2019 | Halter et al. |
| 2019/0043314 | A1 | 2/2019 | Abrahamson |

FOREIGN PATENT DOCUMENTS

| | | |
|---|---|---|
| WO | 0043087 | 7/2000 |

*Primary Examiner* — Omkar A Deodhar
(74) *Attorney, Agent, or Firm* — Weide & Miller, Ltd.

(57) ABSTRACT

Table-based gaming actions are disclosed where additional prizes or other gains can be awarded when a community event occurs at a given table and the event had been wagered upon by side bets placed at that table. One of the possible awards is that for a shared multi-table progressive jackpot prize that receives contributions from side bets placed at different kinds of gaming tables including ones that have community events of different probabilities of occurrence and/or ones that have different numbers of operational betting positions. Methods are disclosed for equalizing the chance at each betting position for winning the multi-table progressive jackpot prize despite the differences in probability of occurrence of the respective community event and/or different numbers of operational betting positions at the respective tables.

20 Claims, 8 Drawing Sheets

JACKPOT CHANCE FOR RANDOMLY PICKED SEAT POSITIONS AT MIXED TABLES FEATURING COMMUNITY SIDE BETS

PRIORITY

This application claims benefit of U.S. Provisional Patent Application No. 62/895,611, filed Sep. 4, 2019 and originally entitled "JACKPOT CHANCE FOR RANDOMLY PICKED SEAT POSITIONS AT MIXED TABLES FEATURING COMMUNITY SIDE BETS" where the disclosure of said provisional application is incorporated herein by reference in its entirety.

TECHNICAL FIELD

The present disclosure of invention relates to operations of a gaming action support machine and certain associated equipment within a gaming environment.

BACKGROUND

Wagering games typically involve at least some amount of luck in predicting a chance outcome (e.g., a randomized dealing out of playing cards from one or more decks of playing cards, a chance landing of a Roulette ball on compartmentalized sector of a Roulette wheel, etc.). Such games may also involve varying amounts of skill in determining when to wager, when to abstain and how much to wager on which wagering opportunities, including on so-called, side bets. Table-based wagering games typically feature one or more players plus a dealer (human or automated) placed about a game-supporting horizontal table where the chance event or events to be wagered on unfold on the table top (and optionally on a computer screen viewable to all the players). Such table-based games may include, as non-limiting examples, Blackjack, Poker, Baccarat and other types of card, tile and/or chip using games, as well as Roulette, Craps and other types of dice-using games. Such table-based games may allow active players to place side bets on a specific community outcomes that may unfold by chance for all involved around the table. If the specific community outcome occurs (e.g., the Roulette ball landing on "00"), all players at the table who made a side bet on this happening will win something, typically a modestly-sized prize.

It is to be understood that gaming within a table environment is not merely a machine-like physics experiment in chance outcomes. Instead, it often involves social engagement between the various players located around the table for example at different ones of a finite number of player seats or other forms of betting positions. The social environment may further include the dealer (or dealers if plural) and bystanders who may be watching the gaming action from nearby. Enjoyment and excitement of the various participants can be enhanced by allowing for rapid unfolding of gaming results, by requiring timely placement of bets (including side bets), by allowing for occasional winning of large jackpot prizes and/or bonus games, by allowing for chance dispersal of awards (e.g., community awards) to more than just a one player who may have won a current round and by allowing for display of interesting light patterns and production of game-related sounds. U.S. Pat. No. 5,743,798 (Adams) and U.S. Pat. No. 5,393,067 (Paulsen) disclosed various forms of coin sensors (also known as input sensors or bet sensors) used for registering wagers for progressive jackpots on table games (including community games such as roulette).

One class of table-based games utilizes a relatively large video or other electronic display monitor mounted on or near the table so that players (and optionally bystanders behind them) can easily see parts of the gaming action. The monitor displayed gaming action may include the showing of a virtual wheel of chance, showing its spin motions and the possible results that may ensue from the wheel stopping its spin so that a specific pie slice or other like segment of the wheel is selected (e.g., pointed to) as the spin outcome. The spinning of the wheel and the displayed possible outcomes adds a sense of excitement and expectation for players (and for bystanders). Monitor displayed gaming action may include the showing of more than one wheel spinning at roughly the same time. Moreover, monitor displayed gaming action may alternatively or additionally show the current amount of a pending jackpot prize and/or amounts that various players are currently wagering on respective gaming action outcomes. The jackpot prize may be a progressive one that grows over time until it is won. Predetermined amounts are taken out of each participating player's wagers to contribute to the growth of the progressive jackpot. Generally, a same amount is taken from each player (or more specifically, from each betting position) for a given pool they are contributing to such that fairness is maintained with each player having a same chance to win the jackpot based on having bet a same amount at each active betting position. The more players there are (or more specifically, the more active betting positions) there are participating, the faster the jackpot grows and emotional anticipation for a win of the jackpot mounts. It is to be understood that when wheels of chance are mentioned herein, it is also within the contemplation of the present disclosure to use alternate but basically equivalent mechanisms that makes random selections among a plurality of possible outcome. These basically equivalent mechanisms can include one or more of spinning reels such as conventionally found on slot machines, virtual dice that are tossed, virtual cards that are randomly pulled from a randomly shuffled deck or alike other means. Typically, one or more random number generators (RNGs) are used for determining the outcomes to be displayed when the wheels of chance or their equivalents settle into a finalized state. However, alternative prior art methods such as the "pull tab" can be used to determine outcomes.

One sub-class of table-based games allows for awarding of so-called, community event prizes to all players at a given table who placed a community side bet predicting a community shared, chance outcome that is relatively rare (e.g., probability of occurrence is than 10%). For example, if the Roulette ball lands on the double oh ("00") compartment, all players at the table who placed a side bet on that community shared, relatively rare chance outcome (e.g., "00") are modestly rewarded. In one embodiment, the amount of the community award depends on a random outcome of a spin of a community-prize selecting wheel that is activated soon after the specified community event unfolds (e.g., they each win a modest prize such as $50 or $10). This community-price selecting wheel is also sometimes referred to herein as a first wheel. In yet a more specific version of such community awarding games, and to make things even more exciting, after the first wheel spins (or simultaneously with its spin), a second wheel is spun to randomly pick one of the N seat positions or other forms of betting positions (e.g., sensor-bearing positions) at the gaming table (e.g., at the Roulette table, where N is an integer such as between 5-8). If the randomly picked one-out-of-N betting position is occupied by an active player who placed a side bet on the community outcome for the current gaming action round, that lucky player at that picked betting position is given an opportunity to have a third wheel spun for him or her exclusively for a chance at a much larger prize, for example for a large progressive jackpot prize. (In one embodiment the picked player initiates the spin of the third wheel. In an alternate embodiment, the third wheel is automatically spun and in some cases this is done even if there is no player at the picked betting position and substantially simultaneously with the spinning of the second wheel.) If there is no side-bet placing person at the randomly picked, one-out-of-N betting positions, the chance for the winning of the larger prize (e.g., the jackpot prize) is lost. In one embodiment, the third wheel is automatically spun and its outcome revealed even if there is no side-bet placing person at the randomly picked betting position. This lets players and bystanders know that they "could have" won the jackpot (or other large prize) if only a side-bet had been placed at the picked betting position. The result is that more players are encouraged to take positions around the table, wager there and place side bets more often. This tends to increase social engagement, emotional excitement, and also increases revenues for the casino over the long run.

The concept of random seat picking is not limited to Roulette tables. Community awards and seating based chances for the jackpot can be provided at card tables, for example in Blackjack where players may place side bets on the dealer going bust in a certain way. One example of a betting-position based prize opportunity is seen in the AGS Bonus Spin Extreme™ game as described in U.S. Ser. No. 15/936,400 to Abrahamson which is incorporated herein by reference in its entirety. Said U.S. application, which is also referred to here as Abrahamson '400 early published as Pre-Grant No. 2019/0043314 on Feb. 7, 2019. In Abrahamson '400, certain community-based outcomes are deemed as further-bonus triggering events in which one of the finite N betting positions at the table (where N is an integer, generally greater than two, e.g., N=6) is randomly chosen, and if there is an active side bet placed for that spot (e.g., one that was has just placed as contributing to a jackpot pool), the lucky player at that betting position gets a chance to spin for an enhanced prize such as a progressive jackpot prize or another relatively large prize (could be less than the biggest jackpot on the wheel). Alternatively, the third wheel is automatically spun and the outcome-selected prize (enhanced prize) is automatically awarded exclusively to him or her. In one embodiment, all three wheels are spun at about the same time as concentric wheels of different diameters. In one embodiment, the wheel (or wheel portion) that picks the lucky one out of N betting positions has the largest diameter and it settles into its final outcome state last. The amount of the exclusive prize for the lucky betting position is revealed beforehand. This provides excitement for the active players seated at the table, especially if the revealed exclusive prize is a big jackpot prize. The generated excitement encourages players to keep placing side bets that add to the growing progressive jackpot in hopes that they will be picked as sitting in (or standing at) the lucky betting position. The jackpot pool amount grows faster as more players come to sit at the table and keep contributing to the jackpot pool by way of side bets made round after round. The jackpot pool amount can grow even faster, and excitement can be further enhanced, if multiple tables all playing the same community-based game at identical tables, contribute to a multi-table-shared or common jackpot. This form of multi-table progressive jackpot maintains fairness for all involved players because they each contribute the same amount of out of their side bet (e.g., a fixed side bet amount such as $5) in each round to the shard prize pool and they each have the same probability of winning a chance to spin the jackpot-providing wheel (or have it spun for them) so as to thereby win the common jackpot or other pooled progressive prize by chance because they are all playing the same community-based game at identical tables.

All tables on the casino floor do not however, necessarily have a same community-based game being played thereat or a same finite number of operational betting positions (e.g., seats) available at the table. Some tables may offer a specific type of Blackjack game, or Poker game, or Baccarat while others offer Roulette, Craps or something else. Although casinos would like to link as many tables as possible for growing a common jackpot even faster, it appears that such tables of different kinds (e.g., Roulette, Baccarat, Blackjack, Poker) cannot be linked together for creating faster-growing common jackpots because the players at these different kinds of gaming tables face different odds and different community prize triggering events and also there can be a different number of operational betting positions (e.g., seats) at the different tables.

The linking together of different gaming machines has been accomplished for slot machines and alike, non-community games in which seating position at each machine is not a factor and a community prize is not being awarded in combination with an individualized chance for the jackpot. More specifically, U.S. Pat. No. 10,332,348 issued to Halter et al. on Jun. 25, 2019 and entitled "SYSTEMS AND METHODS OF LINKING GAMING STATIONS" discloses a method of normalizing the odds for active players such that each has the same odds to win a major progressive jackpot regardless of the specific wagering game being played (a non-community game) at each respective slot machine. Halter '348 does not contemplate wagering games where seating position (or more generally, betting position) might be a factor in determining outcome and where a community prize is being awarded in combination with an individualized chance for a progressive or other kind of jackpot.

Also, as disclosed in U.S. Pat. No. 5,743,800 and/or DEQ's G3 system, a random player and/or random table could be decided to be a winner without regard to the underlying hand result—this being a form of mystery prize.

It is to be understood that some concepts, ideas and problem recognitions provided in this description of the Background may be novel rather than part of the prior art.

SUMMARY

Embodiments in accordance with the present disclosure of invention comprise methods of linking together different gaming tables having different community-based games played thereat and/or different numbers of operational betting positions provided thereat where player position is a factor in determining outcome with respect to a common jackpot for the linked together tables.

One aspect of the disclosure relates to a method of linking together a plurality of gaming tables each having a respective plurality of respective betting positions such that the linked-together tables can provide for placement of respective community-based side bets at their respective betting positions where the placed side bets contribute to a shared multi-table progressive prize pool, where at least one of the tables is different from another of said tables and the method comprises the steps of: (a) establishing a target probability P(Target) to be had for each respective betting position at which a side bet had been placed on a respective community event of a respective one of the linked-together tables such that all respective betting positions at which respective side bets of equal contribution had been placed have a same chance to win the shared multi-table progressive prize; and (b) based on the respective probability of occurrence P(Trigger_a)$_X$ of the respective community event at each respective one of the linked-together tables (each identified by a respective identifier, X) and based on the respective number of operational betting positions $N_X$ at each respective one of the linked-together tables, adjusting the probability of occurrence of a win of the shared multi-table progressive prize at the respective table X by a given betting position at which a side bet had been placed, where the prize is awarded exclusively to the given betting position if the given betting position is selected by chance among the respective $N_X$ operational betting positions of the respective table, where the adjustment assures that each respective betting position at which a side bet had been placed on each of the linked-together different gaming tables has an equal chance to win the prize, the equal chance being the established target probability P(Target).

In one embodiment, three concentric wheels (or their equivalents, e.g., side-by-side reels) are spun at substantially the same time in response to occurrence of a pre-specified community event at a respective one of plural linked-together gaming tables (those contributing to a shared multi-table progressive prize pool) where a first of the wheels determines a community prize to be awarded to all players at the respective table who placed a side bet on the occurrence of the pre-specified community event, where a second of the wheels selects by chance one of N operational betting positions at the respective table and where a third of the wheels determines an enhanced prize to be awarded exclusively to the one-out-of-N picked betting positions if a side bet had been placed there for the given round of gaming action at the respective table. In one embodiment, the third wheel settles and reveals the enhanced prize before the second wheel settles and reveals which of the N betting positions at the respective table is eligible for the revealed enhanced prize. In one embodiment, while the second wheel is slowing down in its spin to reveal the eligible one-out-of-N betting position, lights at respective betting positions around the respective table light up in turn and then off in synchronism with the positions being then referenced by the slowing down second wheel so that players at the table can better see the fickle finger of chance moving around the table to finally settle on the lucky betting position.

Further aspects, features, and advantages of embodiments provided in accordance with the present disclosure of invention will become apparent from the below detailed description and associated drawings.

DETAILED DESCRIPTION

In the following description, numerous specific details are set forth in order to provide a more thorough description of illustrative embodiments in accordance with the present disclosure of invention. It should be apparent, however, to those skilled in the art, that the illustrative embodiments are not limiting and the teachings of the present disclosure may be practiced in other ways without need for one or more of the specific details. In other instances, well-known features have not been described in detail so as not to obscure the disclosure.

Figure 1A:
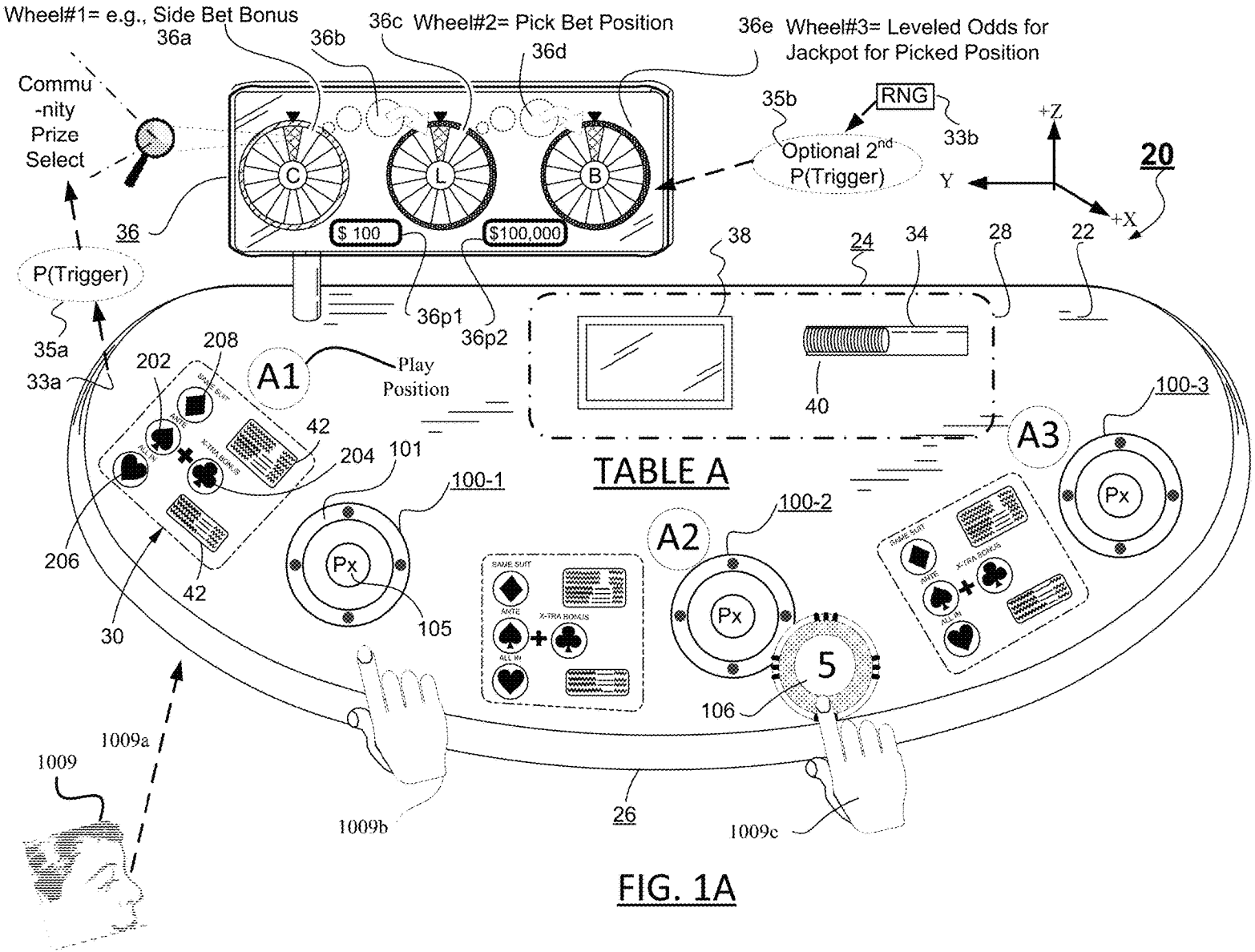
FIG. 1A illustrates a gaming table in accordance with one embodiment of the present disclosure of invention.

One embodiment of a gaming table in accordance with the present disclosure of invention will be described with reference to FIG. 1A. As illustrated in FIG. 1A, a horizontal game playing surface, such as a gaming table 20, is provided. The gaming table 20 includes a top or playing surface 22, typically a textured, contoured and/or marked playing surface 22. The gaming table 20 may include one or more supports, such as a base, legs or the like (not shown) via which the playing surface 22 is elevated above a supporting surface such as a casino gaming floor. Although not shown, secured electronic communication and power cables may extend through one or more of the table supports to connect with casino electronic networks and power distribution means provided under the casino gaming floor. Various sensors and indicators (not all shown) may be embedded within the table.

The shape of the playing surface 22 may vary. In one embodiment, the gaming table 20 has a rear, dealer's side edge 24 (encountered when heading on the table in the −X direction) which is generally straight. The table 20 further has an opposed front edge 26 (encountered when heading on the table in the +X direction or a similar radial direction) which is generally arcuate. Resilient bumpers or cushions may be located about either or both edges 24, 26. Players such as 1009 (only one shown) typically position themselves distributively about the arcuate front edge 26 to align with marked betting positions (e.g., A1, A2, A3) while a casino dealer (not shown) typically positions him or herself behind the rear edge 24.

In one embodiment, the playing surface 22 is predominantly planar. However, the playing surface 22 could have one or more raised areas and/or one or more depressed areas or other features which are integrated into the table or added to the table, such as by being located on or mounted to the top surface thereof. Various game-related information or features are preferably associated with the gaming table 20. In one embodiment, the playing surface 22 comprises a gaming felt or similar element(s) which are located over a substrate, such as a planar support. The gaming felt may bear game play information or other information specific for a particular type of game, such as by printing on the felt. This information may vary, depending upon the game or games which are to be implemented at the gaming table 20. For example, printing on the gaming felt may comprise one or more payout schedules or tables 42, special markings (e.g., 202-208) for where cards are to be located or when wagers are to be placed and other such markings.

In one embodiment the special markings 202-208 are for a specific type of card game where each participating player is required to place an ante wager and possibly also a secondary wager at specific times as different ones of the marked areas 202-208 light up. For example the ante wager is moved on to a player's primary input sensor 100 (describe below) when the ante wager location 202 lights up (e.g., using embedded green LEDs—not shown). Then a secondary wager is optionally input when location 204 lights up on the gaming table 20. The sizes of the ante and secondary wagers may have respective minimum and/or maximum values, and in one embodiment, they are required to be of the same amount or size. If a player desires to place a tertiary wager, the player preferably places the wager onto his or her input sensor 100 when a tertiary (e.g., All-In) wager location 206 lights up on the gaming table 20. Alternatively or additionally, one or more bonus or side bets may be placed when one or more bonus or side bet locations 208 light up on the table 20. Each of the bonus or side bets may respectively have a required minimum or maximum value and a specification for what community outcome is being bet on. In one embodiment, a player can only place a bonus or side bet if the player also has already placed any required prior wagers, such as the ante wager and a secondary wager. It is to be understood that the described lighting up of specifically marked areas 202-208 on the table surface for indicating when specific types of wagers are to be moved onto each player's input sensing device 100 (e.g., 100-1, 100-2, 100-3) is one possibility. Alternatively or additionally, the indication of which wager can be placed on the sensor 100 and when and where, as well as any required amounts; may be displayed on the mounted display screen 36.

In one embodiment, the configuration of the gaming table 20, such as via elements which are associated with the table 20 and information printed on the gaming felt, defines a dealer station 28 from where a dealer may run a game, and one or more player betting positions 30 (e.g., denoted as A1, A2, A3 of Table A). The dealer station 28 is generally located by the rear edge 24 while the player's betting positions 30 (only one referenced as such in the drawing) are located along the front edge 26 opposite to the dealer station 28. The dealer may, for example, stand at the rear of the table adjacent to the dealer station 28. Each respective player (e.g., 1009) may stand or sit adjacent to a respective betting position 30 provided on the gaming table 20.

In one embodiment, at least one game which is played at the gaming table 20 is a foundational wagering game such as Blackjack or Poker. Side bets can be placed on chance community outcomes ancillary to the foundational wagering game. An example of an ancillary community outcome is one where the Blackjack dealer goes bust in a certain way (e.g., a bust 26 outcome) and one or more players have placed side bets that the dealer would go bust in that round and that way. Even if those players do not win based on their individual hands in the given round, they nonetheless win something (typically a modestly sized prize, say $50 or $100) based on their anticipatory side bet that the dealer would go bust when the bust actually happens. Both of the foundational and side bet wagers may be placed by moving physical gaming chips (e.g., 106) or other elements into predetermined wager indicating positions (e.g., 105) at indicated times. In one embodiment, the chips have at least one of RFID or like transponders embedded in them and wagers placed by players as well as the amounts of the wagers may be sensed by detecting the chip-embedded RFID or like transponders associated with the respective gaming chips (or other wagering implements) as they placed in proximity with one or more input receiving devices or input sensors 100 (where the three specific ones in the illustration are respectively denoted as 100-1, 100-2 and 100-3). For the illustrated embodiment 20, the input receiving devices or input sensors 100 are structured to each include a circular outer ring of visible light sources denoted as 101 (e.g., red LEDs). These light sources may be controllably lit in different patterns depending on current gaming states.

At the center of each input sensor 100 is a proximity detector denoted as 105 and also as Px. The proximity detector 105 is configured to distinguish between a player's hand 1009*b* approaching or passing by it and a circular disc-like wagering coin or token 106 passing by it in (e.g., as slid thereto by player's hand 1009*c*). In one embodiment, as mentioned, the wagering tokens have RFID or like transponders embedded in them so as to differentiate them from a player's hand and also optionally to indicate their respective monetary values. Other means for differentiating between a player's hand and placed wagering coin or token are possible.

The proximity detector 105 is further configured to be able to detect and distinguish among various gestures made by the player's hand or fingers 1009*b* such as tapping for a hit or waving to indicate a folding out decision.

Optionally, the gaming table 20 may have additional button shaped other input devices (wired or wireless, not shown) that are alternatively actuated by the placed chips and/or by the player. In the case of the additional sensors (not shown), the sensors may be any type of proximity sensor including, but not limited to, magnetic, electromagnetic (e.g., RFID), IR, acoustic, capacitive, or the like. For example, the input receiving devices (not shown) might comprise capacitive type sensors such as Lanbao CR30S™ series capacitive sensors (produced by Shanghai Lanbao Sensing Technology Co.; www.shlanbao.cn), which sensors behave as standard electrical 4-pin switches where the switch status changes when a chip (or other object, such as a player's hand) is placed on it. In another embodiment, the additional input receiving devices or sensors (not shown) might comprise light sensing devices which measures the distance between the sensor and a chip (or other object, such as a player's hand), such as the VL6180X™ ambient light sensing proximity sensor produced by STMICRO (www.st-.com).

In one embodiment, one or more of the primary input receiving devices 100 are each associated with a respective player position 30 (e.g., A1, A2, A3), thereby providing a means for each player to provide inputs relative to game play at the gaming table. The input receiving devices 100 are operatively coupled to an electronic game controller (not shown, see briefly 1000 of FIG. 2) such that wagers may be easily placed without need for verbal communication.

In one embodiment, the dealer station 28 may include one or more chip trays 34 which are located on or at the gaming table 20 for storing chips 40 which may be used to pay player winnings and/or in which chips which were used by players to place wagers may be collected by the dealer.

In one embodiment, the gaming table 20 may include a number of other features. For example, the gaming table 20 may include one or more above-the-table displays 36 (above the table as measured along an orthogonal Z axis). The above-table displays (e.g., 36) may comprise one or more single or double sided electronic image displays (such as an LCD, LED, OLED, DLP or other types of displays) or might even comprise mechanical and/or electro-mechanical display devices such as one or more mechanical spinning wheels or reels. The above-table display 36 may be located at or near the gaming table 20 for use in displaying game related information such as pay table information, game status information, game outcome information, bonus information or the like. All players (e.g., 1009) about the table have an unobstructed line of sight 1009*a* to the displayed imagery. The table display 36 might also be used to display promotional information (e.g., reward possibilities) or advertising. In one embodiment, a larger slave copy (not shown) of the main above-table display 36 may be located on a wall near the table so that on-lookers can easily view the gaming action as it develops at the corresponding table.

As mentioned, the gaming table 20 might also comprise or include various input devices and/or other display devices. The input devices might include one or more dealer-controlled input devices such as one or more buttons and/or a dealer-controlled touchscreen display 38. For example, the dealer display 38 might comprise a display which displays game-related information to the dealer and allows the dealer to provide various inputs. Of course, various other types of input and display devices might be associated with the gaming table 20. The gaming table 20 might also include player-controlled touch-screens, inputs buttons or the like.

Additional details of a gaming table in accordance with one embodiment of the invention will be described with reference to FIG. 2. As illustrated, in this embodiment, elements of the gaming table 20 are associated with or connected to at least one table controller 1000. The table controller 1000 may be located at the gaming table 20 or may be remote therefrom; for example protectively secured in a locked cabinet elsewhere in the casino.

In one embodiment, the table controller 1000 comprises one or more instructable data processing units typically referred to as processors 1002 (only one shown) which is/are configured to execute respective data processing operations in accordance with non-transitory machine readable code fixed in a tangible medium (e.g. "software"). The table controller 1000 may also comprise one or more information or data storage devices 1004 (only one shown). These data storage devices 1004 may comprise any type of data storage device such as on or off chip cache, ROM, RAM, EPROM or the like, as well as mass storage devices such as hard drives. The data storage devices 1004 may store various data, including game code or software which is executable by the processor(s) 1002 and other data, such as game data including wager data, game outcome data, images, etc.

The table controller 1000 preferably includes one or more communication interfaces 1006 (only one shown). The communication interface(s) 1006 may facilitate wireless and/or wired communications with one or more remote systems or devices in accordance with various protocols (USB, Wi-Fi, Bluetooth, Ethernet, Firewire, etc.). In one embodiment, data or information may be exchanged between the processor(s) 1002, data storage device(s) 1004 and communication interface(s) 1006 via one or more data exchange fabrics, such as a system bus 1008. Of course, the table controller 1000 might have other configurations, including other elements or features.

Figure 2:
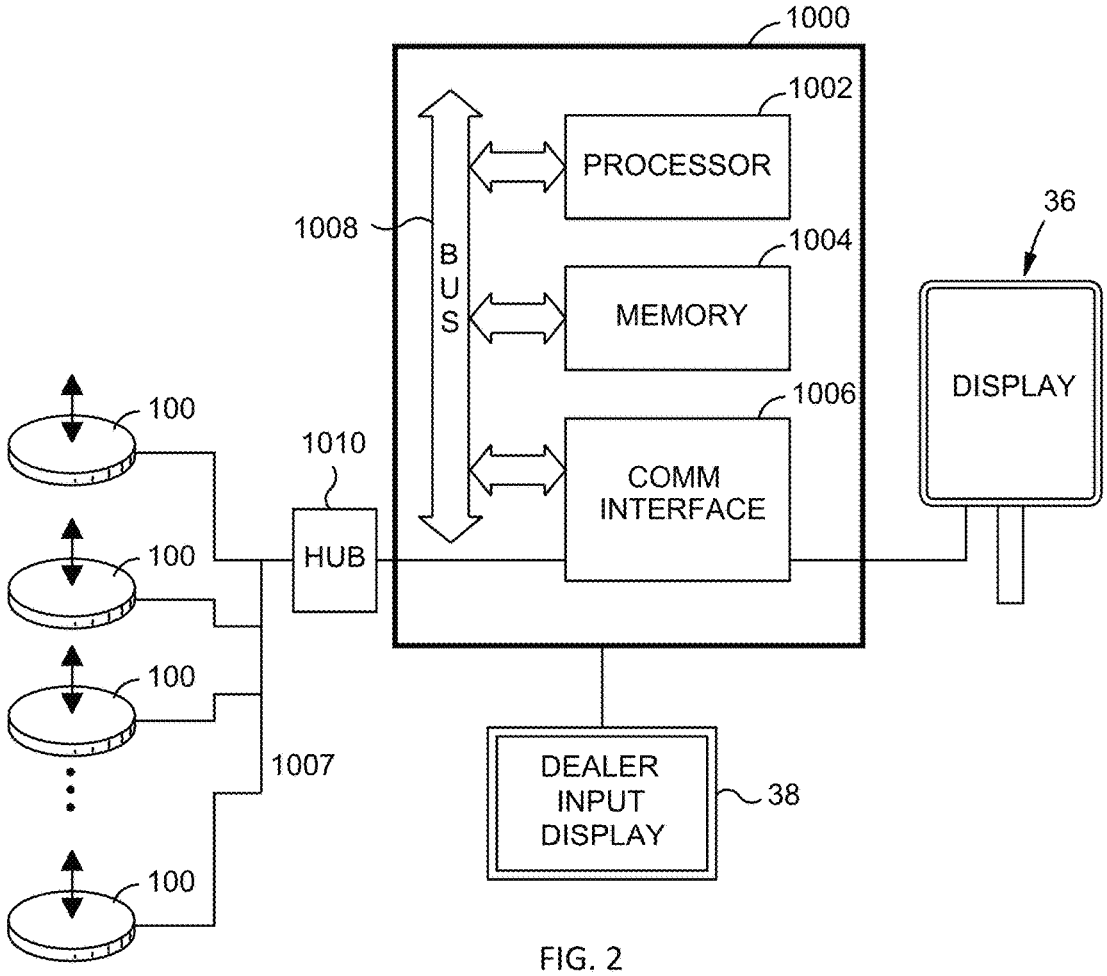
FIG. 2 illustrates a gaming table managing system in accordance with one embodiment of the present disclosure of invention.

As illustrated in FIG. 2, the one or more primary input receiving devices 100 of the gaming table 20 may be interfaced with the table controller 1000 so that the table controller 1000 may receive information from those devices 100 and, in some embodiments, may also transmit information (e.g., desired light patterns for the visible light sources 101) to those devices Likewise, the dealer input and/or display devices, such as the dealer touchscreen 38, may be interfaced to the table controller 1000. Also, other input and/or display devices such as the table display 36 may be interfaced to the table controller 1000.

In one embodiment, the table controller 1000 and/or other devices (e.g., external and operatively coupled other data processing devices, not shown) associated with the gaming table 20 may determine player monetary or chip value balances, including based upon monies associated with play at the table 20 by the player (such as chips purchased), amounts wagered, amounts won, wheel of chance spin outcomes and the like.

The gaming table 20 of the present disclosure may include or be associated with other elements or devices. For example, the gaming table 20 might include other gaming equipment, such as one or more player displays (such as located at each player position 30 and configured to display game information, player tracking information, advertising or other information), card shoe(s), card reader(s), card shuffler(s), player tracking devices (such as for reading a player tracking card or other media of a player for use in tracking the player's game play) and the like. The gaming table 20 might also be connected to external devices. For example, the table controller 1000 might be securely coupled (by wire, fiber and/or wirelessly) to one or more casino servers or other data processing systems. These may include a casino accounting server which tracks game play at each of plural gaming tables such as 20, where the tracking may collect information such as that relative to the amounts of wagers placed and winnings paid to the players, among other information. The gaming table 20 might also be connected to a player tracking server and include player tracking elements such as player card readers.

The gaming system might include yet other elements, such as input receiving device controllers or the like. In one embodiment, the input receiving devices 100 (example ones denoted as 100-1, 100-2 and 100-3 in FIG. 1A) communicate with a hub or aggregator 1010 which communicates with the table controller 1000. The hub 1010 may be configured to read or determine the status of each input receiving device 100 and provide information to the table controller 1000, such as for example, when the status of an input receiving device 100 changes. The hub 1010 may also comprise a power source for the input receiving devices 100. As another example, a proximity-type input sensor might be configured as a USB type device having a USB controller. The table controller 1000 may be configured to control the proximity device as a USB device. In this regard, the processor(s) 1002 and/or one or more sub-processors or controllers may be utilized to control the input receiving devices 100 and/or the hub 1010. Although not explicitly shown as such, in one embodiment, the hub 1010 may communicate bidirectionally with one or more of the input receiving devices 100 using a daisy chain type serial link 1007 in which each input receiving device 100 is assigned a unique identification (e.g., address) and information is relayed serially from one device 100 to the next such that the serially relayed information (data signal) reaches its addressed target (e.g., a specifically addressed device 100, two or more multicast-wise addressed devices 100 and/or the hub 1010).

In one embodiment, different input devices might be utilized for receiving different inputs (such as one input device for receiving a foundational wager input, another input device for receiving a side bet wager input and another input device for receiving a "spin" initiating or halting input or the like). In another embodiment, the one or more input receiving devices 100 are configured to receive a plurality of different kinds of inputs. In other words, each input receiving device 100 may be configured to receive two or more inputs, for example hand gestures and wagering tokens of different denominations. The inputs may be game-related inputs by a player and comprise two or more different types of inputs at two or more different times.

In one or more embodiments in accordance with the present disclosure of invention, aspects of the input receiving devices 100 and/or other devices or elements may be controlled or utilized to facilitate the receipt of the different player inputs. For example, the input receiving devices 100 and/or the table controller 1000 may be configured to control the receipt of inputs, such as by selectively activating and deactivating the input receiving devices 100 so that they will receive respective inputs at certain respective times, but not others (e.g., no more wagering placements accepted after the gaming action of a given round has begun). In other embodiments, the respective configurations of the respective input receiving devices 100 may change to facilitate detection and filtering of correspondingly expected input(s), such as by changing a detecting sensitivity to thereby distinguish between an intended player input and an unintended input. In yet other embodiments described herein, one or more secondary elements, such as audio and/or visual indicators may be used in conjunction with the input receiving devices 100 to facilitate the input receiving functionality of the input receiving devices 100. In one embodiment, wherein a specific one of N operational betting positions around the table is randomly selected by the spin of a wheel of chance (e.g., wheel 36*c* as shall be detailed below), the light outputs 101 of the input devices (e.g., 100-1, 100-2, 100-3) and/or the selectively lightable marked areas (e.g., 202-208) of respective betting positions (e.g., A1, A2, A3) are sequentially turned on and off in synchronism with the spinning, slowing down, and settling of that wheel of chance (36*c*) so that players at the table can better see the fickle finger of chance moving around on the table before it finally settles on a specific betting position (e.g., A2).

In one example embodiment, a wagering game may be presented at the gaming table 20 where the game may has a foundational or core game portion and an optional secondary or bonus game portions. For example, the foundational game portion may comprise a card game (e.g., Poker) which is played with one or more decks of physical playing cards. The bonus game might be triggered by the occurrence of a community event 33*a* within the core game portion that has a relatively low probability (e.g., P(Trigger) <10%). When this triggering event 33*a* (having a probability of occurrence indicated at 35*a* as P(Trigger), and also later herein as P(Trigger_a)) occurs, the dealer and/or embedded sensors may activate a portion of the table software that provides for spinning of one or more chance bonus wheels (e.g., 36*a*, 36*c*, 36*e*). In one embodiment, the triggered spinning of chance wheel 36*a* (WHEEL #1) determines a community prize to be awarded to each of all the players at the table who placed a side bet on the occurrence of the low probability triggering event 33*a*. In one embodiment, the triggered spinning of chance wheel 36*c* (WHEEL #2) determines a betting position that, if occupied and has a side bet locked into it, can be awarded a substantial and exclusive, "enhanced" prize (e.g., a multi-table progressive jackpot amount 36*p*2) based on a co-triggered spinning of chance wheel 36*e* (WHEEL #3). In one embodiment the spinning of these respective wheels is automatically initiated by the table software (as executed in the table controller 1000 or elsewhere). In one embodiment, WHEEL #3 (36*e*) settles on its final outcome (e.g., big jackpot or a smaller prize) before WHEEL #2 (36*c*) is in the process of slowing down and settling on its designation of the lucky betting position (lucky only if it is occupied and has a locked-in side bets thereat). In an alternate embodiment, the spinning of one or more of these respective wheels may be initiated by a tapping gesture by a player finger over the Px detector 105 of a pre-identified betting position. The wheels and their respective spinning and settling actions may be displayed in various ways, including those described in the here incorporated Abrahamson '400 application.

Although FIG. 1A indicates the presence of at least one pre-specified triggering event 33*a* (having probability of occurrence 35*a* of P(Trigger)<10%) for initiating the spinning of the third wheel 36*e* (WHEEL #3) on behalf of a randomly picked betting position (as picked by chance WHEEL #2, a.k.a. 36*c*), it is within the contemplation of the present disclosure to have more than one triggering event for initiating the spinning of the third wheel 36*e* (WHEEL #3) on behalf of a randomly picked betting position. In one embodiment (as will be detailed later below), there is at least a second triggering event 33*b* (e.g., set off by a random number generator or RNG; or in an alternate embodiment, by use of a "Pull Tab" system—described below) having a probability of occurrence denoted as 35*b* where a first of the triggering events, 33*a* is the occurrence of a relatively rare community event in the core wagering game (e.g., P(Trigger_a)<10%) and the second of the triggering events, 33*b* is based on the outcome of a random number generator initiated when the current round of the core wagering game completes and the first triggering event 33*a* has not occurred. The second triggering event 33*b* may comprise initiation by an RNG and then display of a further wheel of chance (similar to 36*a*) where the RNG determines frequency of occurrence of that further wheel and then the further wheel determines whether the third wheel 36*e* (WHEEL #3) will be spun on behalf of a randomly picked betting position or if an alternate prize or no prize will be awarded exclusively to that betting position. The second triggering event 33*b* may also having a relatively low probability 35*b* (e.g., P(Trigger_b)<10%) and it may be understood as supplementing the first triggering event 33*a* for initiating the spinning of the third wheel 36*e* (WHEEL #3). The optional presence of the two or more triggering events (e.g., 33*a* and 33*b*) means that the probability for initiating the spinning of the third wheel 36*e* (WHEEL #3) on behalf of a randomly picked betting position is equal to the sum of the respective probabilities of the two or more triggering events (e.g., P(Initiate)=P(Trigger_a)+P(Trigger_b)). Preferably, the sum, P(Initiate) is also less than 10%. It is within the contemplation of the present disclosure to have more than one probability-supplementing triggering events like 33*b* such that P(Initiate)=P(Trigger_a)+P(Trigger_b)+P(Trigger_c)+ . . . etc., where preferably, the sum, P(Initiate) of the 3 or more triggers is less than 10%. The purposes of the second trigger 33*b*, of the third trigger (33*c*—not shown) and so on, need not be the same as will become clearer from the below discussion about hybrid variations.

It is to be understood that discussions herein of respective wheels of chance or their equivalents also contemplate use of the so-called, "Pull Tab" method. The "Pull Tab" method assures that when a specification states that a certain progressive prize (e.g., big jackpot) or other by-chance result will be awarded/will occur J out of K times that indeed that prize/outcome will occur J out of K times, no more or no less. More specifically, a virtual deck of cards having exactly KQ cards in it (Q being an identifier of a specific by-chance mechanism) is constructed so as to have exactly JiQ instances in it of each corresponding outcome, i that is promised to occur exactly JiQ out of KQ times (where J and K are integers and KQ≥sum of all JiQ instances). More specifically, if the big jackpot is promised to occur one out of 1000 times, then a virtual card deck is constructed having exactly 1000 cards where only one of those cards designates the big jackpot (e.g., J1Q out of KQ=1/1000). The constructed virtual card deck may additionally fulfill other promises such as that a smaller pool prize will occur three out of one thousand times (e.g., J2Q out of KQ=3/1000) and so on. The card deck is randomly shuffled, preferably using one or more RNGs disposed in a physically and logically secured server and in one embodiment, the shuffling is performed before any game using the shuffled deck begins. Data representing the shuffled card deck is encrypted and then digitally signed. The digitally signed encrypted data is securely transmitted from the server to the gaming controller of a specific gaming machine (e.g., that of a gaming table) and received by a secured pull tab application running inside the gaming controller. The application verifies the signature and de-encrypts the data so as to have a copy of the shuffled deck securely stored and hidden therein. When an executing wagering game or the like needs a random result from a by-chance mechanism identified as Q, it asks the secured pull tab application to pull the next card out of its hidden deck of KQ cards and reveal it to the executing wagering game or the like. A new deck is not retrieved from the secured external server until all KQ cards of the previous deck have been exhausted. This assures that each promised outcome will occur exactly JiQ out of KQ time, no more, no less. The present disclosure contemplates using one or more respective, "Pull Tab" mechanisms for a corresponding one or more of the by-chance mechanisms disclosed herein including, for example, for the first triggering mechanism 33*a* and/or for the second triggering mechanism 33*b* (or for yet other triggering mechanisms that are designated below as 33*c*, 33*d*, etc.).

Still referring to FIG. 1A, In one embodiment, the input receiving devices 100 may be turned off or may be configured to not report inputs except during designated times and/or for software-identified betting positions. This prevents, for example, inadvertent inputs from being received when games are not being presented or when other activities are occurring or when certain betting positions are to be blocked from receiving further inputs according to the current game rules. For example, it may be preferable for the input receiving devices 100 to not report/recognize inputs between games or during certain portions of a game where inputs are not allowed according to game rules.

In one embodiment, the input receiving devices 100 may be turned off by providing a software-driven instruction to them to not receive or transmit inputs. In other embodiments, the table controller 1000 could be configured to ignore input signals from the input receiving devices 100 when certain predetermined conditions exist.

In one embodiment, the input receiving devices 100 may be "activated", such as by turning them on or by causing the table controller 1000 to be configured to receive inputs from the input receiving devices 100. This step may be implemented by a dealer, such as by input to the one or more dealer input devices. For example, the dealer display 38 might display a "start game/receive wagers" touch-sensitive button which the dealer may select. In response to that input, the table controller 1000 may be configured to then receive inputs from the input receiving devices 100 or may send control instructions to those devices to cause them to be activated and may present instructions to respective players such as, "Enter your base bet now". In one embodiment, the visible light emitters 101 of the devices 100 may emit certain lighting patterns (e.g., slow rotating ones) to indicate that they are ready to accept the placement of such wagers. In one embodiment, the dealer (not shown) can use of the touchscreen 38 and/or other input devices for identifying the specific core game being played (and implicitly, its specific rules), for indicating whether community prizes will be awarded, for indicating whether a jackpot spin (36*e*) will be granted for a randomly picked betting position (e.g., A1, A2, A3) and for indicating the number and/or identity of the betting positions that are currently operational on this specific table 20. It is to be understood that sometimes a betting position becomes nonoperational due to a defect in one or more of its critical components; for example when its primary input device (e.g., 100-3) stops working properly. In such a case, the dealer may block all potential players from using that nonoperational betting position and may indicate to the software that the specific betting position is nonoperational. In response, the table software may alter the operation of its position-selecting chance wheel 36*c* (WHEEL #2) to skip over the nonoperational betting position. As a result; if the probability of a position being picked by wheel 36*c* (WHEEL #2) when all N positions were operational was 1/N, then when one of the positions becomes nonoperational, the probability increases to being 1/(N−1). Of course, when two positions are nonoperational, the probability will be 1/(N−2) and so on. Also, there will be a threshold number of nonoperational betting positions above which use of the table is prohibited by predetermined casino rules.

After activation, one or more first inputs may be provided to the one or more input receiving devices 100. This may comprise, for example, a first type of input such as a foundational wager input, such as via the detection of placement of one or more chips when so indicated by lights on the table and/or a display on the table screen 36*a* and/or by the dealer.

In one embodiment, each player who wishes to play the game may be required to place one or more initial/foundational wagers (anting in bets). The player might optionally be permitted to place other wagers at the start of the gaming action and/or at later times as the gaming action progresses. For example, a player might be required to place one or more foundational wagers to play the game and might be permitted to optionally place a bonus and/or side bet wager. In one embodiment, one or more input receiving devices 100 are associated with each player position 30. More than one input receiving device 100 may be provided relative to each player, such as for receiving a base wager and a bonus or side wager.

Figure 3A:
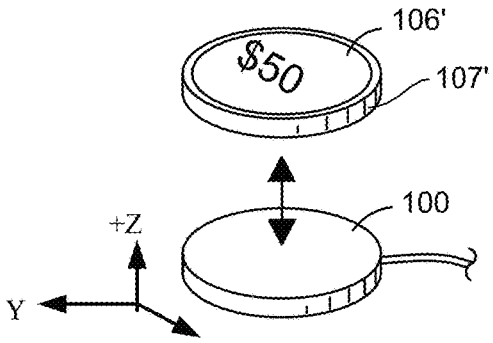
FIGS. 3A and 3B illustrate first and second inputs to an input receiving device in accordance with the present disclosure.

In one embodiment, a wager input may be provided by a player placing one or more chips 40 on or adjacent to a particular input receiving device 100, such as illustrated in FIG. 3A. At that time, the wager input(s) may be detected by those devices 100 and may be transmitted to the table controller 1000 for processing and storage. Wager information may be displayed to the dealer, such as via the dealer display 38. The dealer might then collect the wager-defining chips and place those wagered chips in the chip tray 34. In one embodiment, the visible lights of an input receiving device 100 from which a wager has been collected may glow with a patterned indication that the wager has been accepted and locked-in (even though the token had been removed so that the player cannot withdraw his/her wager) where the pattern indicates the amount of the wager (e.g., slow rotate for $5, faster for $50). The pattern may be one in which the intensity slowly increases and then decreases to intuitively indicate the wager is waiting for a gaming action outcome.

In one embodiment, after a first input period, the input receiving devices 100 may again be de-activated. Once again, this may comprise a dealer providing input to the dealer input device(s), such as the dealer touchscreen 38. For example, the dealer touchscreen 38 might display a "close wager" button which the dealer may select. This may cause the table controller 1000 to no longer receive inputs from the input receiving devices 100 and/or to send a control instruction to those devices to de-activate them. In one embodiment, the visible lights of an input receiving device 100 into which a wager may no longer be placed display a steady red pattern corresponding to a red traffic light.

At one or more times, the input receiving devices 100 may be configured to receive one or more additional or second inputs. Such a secondary input might comprise a secondary or other additional wager. In one embodiment, different time-changing light patterns are used at the devices 100 for indicating acceptability of the secondary input. One or more of the secondary inputs may comprise a different type of input than the first input. In order to receive the at least one secondary input, the input receiving devices 100 may again be re-activated and optionally reconfigured for a different kind of input. In one embodiment, only certain input receiving devices 100 may be activated for receiving particular inputs. For example, a player who placed a bonus wager and received a certain bonus-triggering result from the play of a foundational game might be permitted to participate in a bonus event, such as one or more bonus wheel spins. As described below, in one embodiment, a player might be entitled to a corresponding one or more spins of respective award wheels (e.g., 36*a*) whose outcomes select or determine one or more awards for that individual, such as awards for having won a bet. In one embodiment, a spinnable wheel 36*a* may be used to randomly select a community prize amount. This is a prize that is awarded to each of the players who have currently placed a side bet anticipating the occurrence of a specific community event 33*a* (e.g., the Blackjack dealer going bust, the Roulette ball landing on "00", etc.). The here disclosed spin technology may be implemented relative to a variety of games, including for example blackjack, baccarat, poker and other such card-utilizing or other symbols-collecting games. Preferably, the input receiving devices 100 corresponding to only those player positions 30 entitled to participate in the bonus event, award event or the like might be activated. The input receiving devices 100 relative to the other players preferably remain inactive (and optionally show a red stop pattern), such as to prevent accidental input thereto.

Figure 3B:
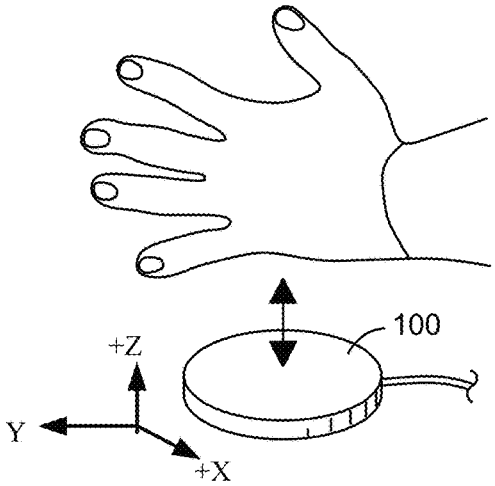

In one embodiment, an input signal might comprise a player placing their hand, one or more fingers or another body part or the like on or adjacent to the input receiving device 100, or waving their hand across the device (for example in a predetermined gesture), such as schematically illustrated in FIG. 3B may be used to indicate player desires to the table controller 1000. For example, in response to the detection by proximity detector 105 of a player's hand making a vertical tapping motion, the corresponding input receiving device 100 may send a signal to the table controller 1000 to initiate a spin of a virtual wheel of chance (e.g., 36*a*). The table controller 1000 may then be configured to cause the table display 36 to display the image of a first wheel 36*a* (e.g., virtual WHEEL #1) which rotates and then settles into a stopped position that indicates a specific award or bonus location (pie slice) as the wheel determined outcome, such as indicated by the hashed wheel slice in FIG. 1A for the illustrated WHEEL #1. The bonus spin outcome or award selection event may result in an individual player or plural players each being awarded a bonus win or a selected award due to the occurrence of the bet-on community event 33*a*. More specifically, in one embodiment, the bonus wheel spin outcome (settled on slice) may determine an award amount being given to each of side bet making players who have bet on a specific community event such as a Roulette ball landing on "00".

In one embodiment, a wager input may be provided by a player placing one or more chips 40 on or adjacent to a particular input receiving device 100, such as illustrated in FIG. 3A. At that time, the wager input(s) may be detected by those devices 100 and may be transmitted to the table controller 1000 for processing and storage. Wager information may be displayed to the dealer, such as via the dealer display 38. The dealer might then collect the wager-defining chips and place those wagered chips in the chip tray 34. The dealer may indicate to the software that those wagers are locked-in.

In one embodiment, after a first input period, the input receiving devices 100 may again be de-activated. Once again, this may comprise a dealer providing input to the dealer input device(s), such as the dealer touchscreen 38. For example, the dealer touchscreen 38 might display a "close wager" button which the dealer may select. This may cause the table controller 1000 to no longer receive inputs from the input receiving devices 100 and/or to send a control instruction to those devices to de-activate them.

At one or more times, the input receiving devices 100 may be configured to receive one or more additional or second inputs. Such a secondary input might comprise a secondary or other additional wager such as a side bet wager. One or more of the secondary inputs may comprise a different type of input than the first input. In order to receive the at least one secondary input, the input receiving devices 100 may again be re-activated and optionally reconfigured for a different kind of input. In one embodiment, only certain input receiving devices 100 may be activated for receiving particular inputs. For example, a player who placed a bonus wager and received a certain bonus-triggering result from the play of the base or foundational game might be permitted to participate in a bonus event, such as one or more bonus wheel spins. As described below, in one embodiment, a player might be entitled to a corresponding one or more spins of respective award wheels whose outcomes select or determine one or more awards, such as awards for having won a bet. The here disclosed spin technology may be implemented relative to a variety of games, including for example blackjack, baccarat, poker and other such card-utilizing or other symbols-collecting games. Preferably, the input receiving devices 100 corresponding to only those players who are entitled to participate in the bonus event, award event or the like might be activated. The input receiving devices 100 relative to the other players preferably remain inactive, such as to prevent accidental input thereto.

In one embodiment, an input signal might comprise a player placing their hand, one or more fingers or another body part or the like on or adjacent to the input receiving device 100, or waving their hand across the device (for example in a predetermined gesture), such as illustrated in FIG. 3B for example, using the above-referenced VL6180X ambient light sensing sensor, where the sensor detects the presence of the player's hand proximate to the sensor and by determining a distance of the player's hand from the sensor by determining a flight time of projected light (e.g., an IR light beam) which is reflected from the player's hand back to the sensor in order to receive the player's hand gesture as a valid input. In response, one or more game features or the like may be implemented by the table controller 1000 and/or dealer in response to the received and recognized input signal. For example, in response to the detection of a player's hand, an input receiving device 100 may send a signal to the table controller 1000. The table controller 100 may then be configured to cause the table display 36 to display the image of a first wheel 36*a* (e.g., virtual WHEEL #1) which rotates and then settles into a stopped position that indicates a specific award or bonus location (pie slice) as the wheel determined outcome, such as indicated by the hashed wheel slice in FIG. 1A for the illustrated WHEEL #1. The bonus spin outcome or award selection event may result in the player being awarded a bonus win or a selected award.

It is to be understood that the exemplary simultaneous display of plural wheels of chance (e.g., WHEEL #1, WHEEL #2 and WHEEL #3 is not necessarily to scale or relative scale and the illustrated plural wheels are not necessarily both displayed or both displayed at apparent same size at a same time. At one point in time, the first wheel (WHEEL #1) may be displayed as large and predominant while the second wheel (WHEEL #2) may be displayed as diminutive or not at all present. Then after WHEEL #1 is spun and its outcome revealed, WHEEL #1 may shrink in size while the second wheel (WHEEL #2) emerges (e.g., it inflatingly bubbles out as indicated at 36*b*) from the outcome slice (hashed) of stopped WHEEL #1 to become a display area dominating next wheel of chance that is to be spun or which automatically begins spinning. The same may be true for WHEEL #3. Although three separate wheels of chance 36*a*, 36*c* and 36*e* are illustrated by way of example in FIG. 1A, it is within the contemplation of the present disclosure to have more than three such wheels. It is within the contemplation of the present disclosure to have the three wheels simultaneously displayed as three concentric wheels of differing diameters, the wheel with the smallest diameter being apparently upfront while the wheel with the largest diameter being apparently furthest back so that the achievable sectors of each wheel are visible. In one embodiment, WHEEL #2 (36*c*) is not displayed and instead the random selection of a given betting position around the table (e.g., A1 or A2 or A3) is indicated by the corresponding lighting and de-lighting of the visible lights 101 of the respective input devices (e.g., 100-1, 100-2 or 100-3) and/or by the corresponding lighting of the selectively light-able marked areas (202-208) in synchronism with exclusive referencing of the betting positions by a random selecting mechanism (e.g., an RNG) as the random selecting mechanism is still spinning and has not yet settled on its final selection. In another embodiment, the second wheel WHEEL #2 (36*c*) is displayed and the corresponding lighting and de-lighting of the visible lights 101 of the respective input devices (e.g., 100 1, 100 2 or 100 3) and/or by the corresponding lighting of the selectively light-able marked areas (202-208) occurs in in synchronism with exclusive referencing of the betting positions by the second wheel WHEEL #2 (36*c*) as the latter slows down to settle on a final decision for the current round of gaming action at the table.

FIG. 1A is drawn to coincide with a specific condition in which one or more players (e.g., 1009) have placed a side bet (e.g., $5—as indicated by hand 1009*c* moving token 106 onto input sensing device 100-2). This illustrated specific condition may correspond to the placing of a side bet on a relatively rare community occurrence (e.g., the blackjack dealer going bust in a certain pre-specified way or a rare multi-player baccarat occurrence happening, for example, a four card tie). If the relatively rare community occurrence 33*a* does occur, it is followed by a triggering of the spinning of the first wheel 36*a* (WHEEL #1) and optionally also by a triggering of the spinning of the second and third wheels, 36*c*, 36*e* (a.k.a., WHEEL #2, WHEEL #3). The triggering may be manually performed by the dealer and/or may be automatically enabled by the table software based on use of sensors in and/or around the table (e.g., video cameras with ability to automatically recognize the triggering event 33*a*). As will be appreciated from studying FIG. 1A, the probability that a given one player (e.g., 1009) will win the jackpot prize (36*p*2) is equal to the probability 35*a* that the triggering event 33*a* will occur multiplied by the probability (1/N) that his or her betting position will be picked by WHEEL #2 (36*c*) and further multiplied by the probability that WHEEL #3 (36*e*) will have the jackpot prize as its chance outcome. This may be expressed by the following equations Eq(1.0), Eq(1.1):

$$P(\text{Win by 1009})=P(\text{Trigger_}a)\cdot P(1/N)\cdot P(\text{Jackpot on } 36e) \qquad \text{Eq(1.0)}$$

where P(1/N)=1/N and N is the number of operational betting positions at Table A.

It will be appreciated that each player at the illustrated Table A will have an equal chance at each respective betting position played by that player (where the playing includes placing of a side bet—where each side bet contributes a same amount to the shared multi-table prize pool)) of winning the jackpot 36*p*2 (or another, contributed to, shared multi-table progressive prize pool). A same contribution towards the progressive jackpot will be taken out of each player's side bet to grow the jackpot. Thus the scheme is equally fair to all the involved players at the illustrated Table A.

Figure 1B:
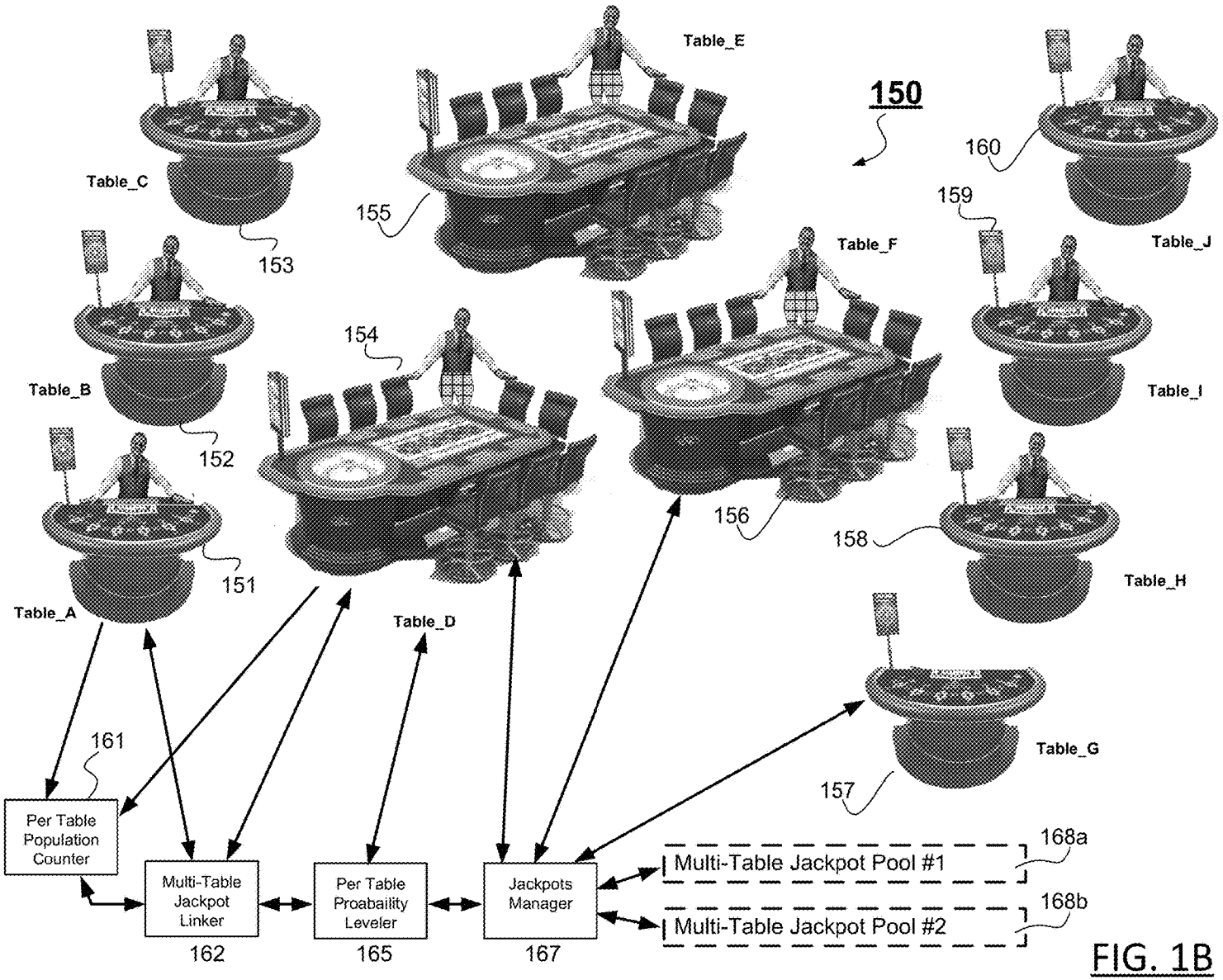
FIG. 1B illustrates a schematic layout for an exemplary casino environment in accordance with one embodiment of the present disclosure.

Referring next to FIG. 1B, shown is an example casino environment 150 having a mix of different kinds of gaming tables and/or games being played at those respective tables. Merely by way of example some of those tables (e.g., 151-153, 157-160) may offer a Baccarat game while others of those tables (e.g., 154-156) may offer a Roulette game. Yet other tables (not shown) in the casino environment 150 may offer yet other types of games including but not limited to, Blackjack, Poker and Pai Gow. Each of these gaming tables (e.g., 151-160) may have a different respective number of operational betting positions ($N_X$, where X identifies the respective table) and a different respective set of relatively rare community events 33$a_X$ on which side bets may be placed. Thus, unlike the condition stated for just gaming Table A of FIG. 1A, each player at each of the different gaming tables will not necessarily have an equal chance at each respective betting position played by that player (where the playing includes placing of a side bet) of winning a collective multi-table jackpot such as 168*a* or 168*b*.

The present disclosure recognizes that equality of opportunity for a collective multi-table jackpot (e.g., 168*a* or 168*b*) can be made to happen if, for example, the following opportunity equalizing conditions (Equations Eq (2.0), (2.1)) are made to occur:

$$P(\text{Win at Table } A)=P(\text{Trigger_}a)_A \cdot P(1/N_A) \cdot W_A \cdot P(\text{Wheel3}_A)=P_T(\text{Jackpot}) \quad \text{Eq(2.0)}$$

$$P(\text{Win at Table } E)=P(\text{Trigger_}a)_E \cdot P(1/N_E) \cdot W_E \cdot P(\text{Wheel3}_E)=P_T(\text{Jackpot}) \quad \text{Eq(2.1)}$$

where: {1} $P_T$(Jackpot) is a predetermined target probability for any betting position winning a multi-table jackpot pool (e.g., 68*a*) shared for example by Tables A (e.g., Baccarat) and E (e.g., Roulette) if a side bet had been placed at that betting position; {2} NA is the number of operational betting positions at Table A; {3} NE is the number of operational betting positions at Table E; {4} P(Trigger_a)$_A$ is the probability of a predetermined respective triggering event 33*a* for a community event at Table A; {5} P(Trigger_a)E is the probability of a predetermined respective triggering event 33*a* for a community event at Table E; {6} WA is a weighting factor applied to a pre-linkage jackpot wheel at Table A having a pre-linkage probability P(Wheel3A) for winning a respective jackpot, where WA is a function of the target PT(Jackpot) and P(1/NA) and P(Trigger_a)A; and {7} WE is a weighting factor applied to a pre-linkage jackpot wheel at Table E having a pre-linkage probability P(Wheel3E) for winning a respective jackpot, where WE is a function of the target PT(Jackpot) and P(1/NE) and P(Trigger_a)E.

More specifically, for a Table X (where X can be A or E or any other of the table identifiers; e.g., A-J):

$$W_X=P_T(\text{Jackpot}) \cdot N_X/(P(\text{Trigger_}a)_E \cdot P(\text{Wheel3}_X)) \quad \text{Eq(2.3)}$$

whereby a substituting of normalizing factor WX into any local table equations such Eq(2.0) or Eq(2.1) produces the equality, $P_T$(Jackpot)X=$P_T$(Jackpot). It is to be understood that rather than performing the multiplication operation WX·P(Wheel3X) to attain the target jackpot probability $P_T$(Jackpot) for each respective table X, the weighted value WX·P(Wheel3X) can be substituted in as the frequency of occurrence for winning the jackpot on the respective WHEEL #3 (or its equivalent). In one embodiment, if respective community event triggers (33*a*$_X$) occur at two or more respective gaming tables at roughly the same time, the table whose community event trigger happened first among all the other tables is deemed to be the table that gets an exclusive chance at spinning its respective WHEEL #3 (or its equivalent). If the spin of respective WHEEL #3 at that table lands on the jackpot sector and the spin of respective WHEEL #2 at that table lands on a betting position (e.g., A2) at which a side bet had been placed, the player occupying that betting position wins the whole jackpot, the corresponding jackpot pool (e.g., 168*a*) is depleted and, in most cases that depleted pool is immediately re-seeded or replenished from a replenishment fund that had been building up over time. The table whose community event trigger happened second time gets to spin for that replenished amount.

It is to be understood that although the above focuses on winning the big jackpot prize, it is within the contemplation of the disclosure to have plural and different progressive prize pools, with some having smaller contributions moved into them from each placed side bet, some larger, and/or with some receiving contributions from a smaller number of linked-together tables, some from a larger number. It is within the contemplation of the present disclosure that the spinning of the third wheel (WHEEL #3 or its equivalent) offers the picked on-of-N betting positions correspondingly different chances to win the big jackpot or the other, smaller progressive prizes. The concepts discussed herein apply to all such lesser prizes as well. For each given such prize, each operational betting position that places a side bet having a contribution taken out of it for the corresponding prize pool, has a same amount taken out of it for that pool irrespective of the specific table X and the chance provided to that contributing betting position is the same as the chance provided to every other contributing betting position for winning the given prize even though the participating betting positions are disposed at corresponding tables having different numbers of operational betting positions $N_X$ and even though the participating betting positions are disposed at corresponding tables having different probabilities of occurrence 35*a*$_X$ for their respective, side-betted-on community events 33*a*$_X$.

The embodiment 150 of FIG. 1B includes a per-table probability leveler 165 that equalizes the chances of winning the jackpot at each betting position of linked-together gaming tables (those linked to a respectively shared progressive prize pool such as 168*a* or 168*b*) by implementing an appropriate normalizing factor $W_X$ for each table X in accordance with the above. More specifically, in one embodiment the casino environment 150 includes a per-table population counter 161 that keeps track of the number of currently active betting positions (e.g., those recently placing foundational bets and/or those recently placing side bets) for each of the plurality of linkable gaming tables (e.g., 151-160). Population counter 161 is operatively coupled to a multi-table jackpot linker 162 that determines which of the linkable gaming tables (e.g., 151-160) are to be linked to one another for contributing to a respective common multi-table jackpot pool such as 168*a* and/or 168*b* (where illustration of just two such pools is merely an example). The predetermined target probabilities $P_T$(Jackpot) 168*a* and $P_T$(Other_prize) 168*b* for the respective jackpot pools 168*a* and 168*b* can be the same or different depending on the other associated factors including the amount of contribution taken out of side bet for each pool, the respective triggering event probabilities 35*a*X at the linked together tables (e.g., A and E) and the sizes of the jackpots that the casino wishes to allow for those respective triggering events (e.g., 35*a*A and 35*a*E). The above concept can be made clearer by referring to the below Table 1 where for sake of example, the big jackpot is being referenced.

TABLE 1

| Table | No. of Seats | Game Name | Community Event | P(Trigger_a) | $W_X \cdot P(\text{Wheel3}_X)$ Weighted Wheel | P(Win) = $P_T$(Jackpot) |
|---|---|---|---|---|---|---|
| A | 7 | ROULETTE | "00" RESULT | 0.0263 | 0.001330 | 0.00000500 |
| B | 7 | BACCARAT (A) | 4 Card Tie | 0.0357 | 0.000979 | 0.00000500 |
| C | 7 | BACCARAT (B) | Dai Bac- | 0.0278 | 0.001258 | 0.00000500 |

TABLE 1-continued

| Table | No. of Seats | Game Name | Community Event | P(Trigger_a) | $W_X \cdot P(Wheel3_X)$ Weighted Wheel | P(Win) = $P_T$(Jackpot) |
|---|---|---|---|---|---|---|
| | | | Any Kill | | | |
| D | 6 | BLACKJACK | BUST 26 | 0.03998 | 0.000750 | 0.00000500 |
| E | 6 | SPANISH 21 | BUST 26 | 0.03444 | 0.000871 | 0.00000500 |
| F | 6 | PAI GOW | Dealer 9, 10, J or Q High Pai Gow | 0.02571 | 0.001167 | 0.00000500 |
| G | 6 | POKER-5 CARD | 3 of a Kind + (community cards) | 0.0287 | 0.001045 | 0.00000500 |
| H | 10 | POKER - CASH GAME | 3 Card Straight-Flop | 0.0348 | 0.001439 | 0.00000500 |
| X | N | Other | Other with P(Event) < 5% | (35a) | $W_X \cdot P(Wheel3_X)$ | $P_T$(Jackpot) |

In the given example of TABLE 1, the alphabetic table identifications do not necessarily correspond to any of those illustrated in FIG. 1B. Instead they provide useful row numbers for the table. The respective community event triggering probabilities P(Event) are each less than five percent (5%) and a decision was made to have a common target probability $P_T$(Jackpot) of 1/10,000 times 5% for winning the jackpot. Of course other target probabilities could have been picked based on various factors including the portion of each side bet that contributes to the respective jackpot pool and the size (monetary value) of the respective side bet. As seen, the respective weighted-wheel probabilities for the different tables are different and are chosen to coincide with the number N of operational seats at each respective table so that the effective probabilities at each table and for each betting position are the same (are equal to the target probability, $P_T$(Jackpot)).

Figure 1C:
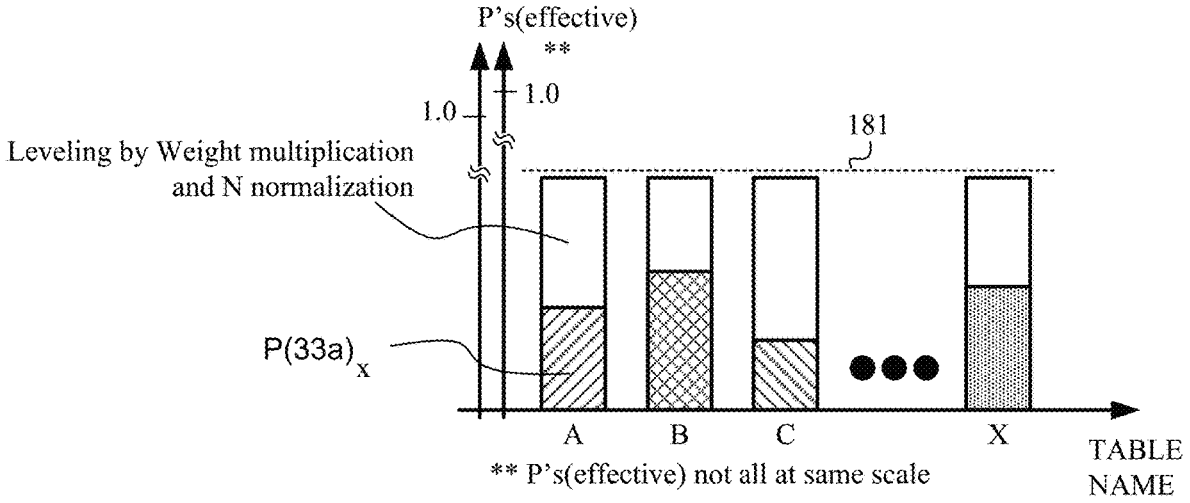
FIG. 1C is a conceptual graph for explaining how probability leveling for winning the jackpot may be achieved in accordance with a first embodiment.

Referring to FIG. 1C, the concept of weighting to achieve a same ultimate probability of winning for each participating betting position (irrespective of the values of $P(Trigger_a)_X$ and of $N_X$ at each table X) is shown graphically. It is to be understood that the illustrated probabilities are actually graphed at different scales. More specifically, level 181 is on the order of ten thousand times smaller than what appears. The concept is being schematically presented as using the weighting factor $W_X$ and the number of operational betting positions $N_X$ at each respective table X (where X equals A, B, C, . . . etc.) to compensate for the different probabilities of occurrence 35$a_X$ of the respective wagered-upon community events 33$a_X$ and the different number $N_X$ of operational betting positions to thus effectuate a same target probability, $P_T$(Jackpot) for all the tables that had been linked together to contribute to a same multi-table jackpot pool (e.g., 168*a* of FIG. 1).

In FIG. 1B, the multi-table jackpot linker 162 may respond to a low active population count (e.g., relatively few players and/or relatively low side bet placing rate) at a given first table (e.g., Table G) by linking it with a second table (e.g., Table D) that has a relatively high active population count (i.e. a relatively large number of actively participating and side bet placing players) and thus has a relatively large progressive jackpot growing for it. This relatively large jackpot may entice more players to join in on the low count first table (e.g., Table G) when the latter is linked with the more active second table (e.g., Table D). This option may be particularly useful if all or almost all the betting positions on the second table (e.g., Table D) are occupied while there are a significant number of empty betting positions at the first table (e.g., Table G). The casino may make a public announcement and/or advertise on its displays that the same large jackpot can be won at the relatively empty first table (e.g., Table G) and/or at other relatively empty tables that have also been linked to the almost full second table (e.g., Table D). The jackpots manager 167 manages the respective contributions made from placed side bets to respective ones of the multi-table jackpot pools (e.g., 168*a* and 168*b*).

In accordance with another embodiment, opportunity leveling for each of betting positions at linked gaming tables of different types may be achieved by adding (summing) a second triggering event 33*b* separate from the occurrence of a community event in the core gaming activity (e.g., the Roulette ball landing on "00"). This second triggering event 33*b* may constitute the showing at a given frequency of a further bonus spin wheel (e.g., an introduced free spin, it could take over the position of WHEEL #1). The concept may be better understood from the following equations:

$$P(\text{Win at Table } A)=(P(\text{Trigger_}a)_A+P(\text{Trigger_}b)_A)\cdot P(1/N_A)\cdot W_A P(\text{Wheel3}_A)=P_T'(\text{Jackpot}) \quad \text{Eq(3.0)}$$

$$P(\text{Win at Table } E)=(P(\text{Trigger_}a)_E+P(\text{Trigger_}b)_E)\cdot P(1/N_E)\cdot W_E P(\text{Wheel3}_E)=P_T'(\text{Jackpot}) \quad \text{Eq(3.1)}$$

where: {1} $P_T'$(Jackpot) is a predetermined target probability for any betting position winning a multi-table jackpot pool (e.g., 68*a*) shared for example by Tables A (e.g., Baccarat) and E (e.g., Roulette) if a side bet had been placed at that betting position; {2} $N_A$ is the number of operational betting positions at Table A; {3} $N_E$ is the number of operational betting positions at Table E; {4a} $P(Trigger_a)_A$ is the probability of a predetermined respective first triggering event for a community event at Table A; {4b} $P(Trigger_b)_A$ is the probability of a predetermined respective second triggering event 33*b* at Table A that occurs at the end of, and otherwise independent of a specific game outcome at Table A where $(P(Trigger_a)_A+P(Trigger_b)_A)$ equals a predetermined first target value; {5a} $P(Trigger_a)_E$ is the probability of a predetermined respective triggering event for a community event at Table E; {5b}$P(Trigger_b)_E$ is the probability of a predetermined respective second triggering event 33*b* at Table E that occurs at the end of, and otherwise independent of a specific game outcome at Table E where $(P(Trigger_a)_E+P(Trigger_b)_E)$ equals a predetermined second target value; {6} $W_A$ is a weighting factor applied to a pre-linkage jackpot wheel at Table A having a pre-linkage probability $P(Wheel3_A)$ for winning a respective jackpot, where $W_A$ is a function of the target $P_T$(Jackpot) and $P(1/N_A)$ and $(P(Trigger_a)_A+P(Trigger_b)_A)$; and {7} $W_E$ is a weighting factor applied to a pre-linkage jackpot wheel at Table E having a pre-linkage probability $P(Wheel3_E)$ for winning a respective jackpot, where $W_E$ is a function of the target $P_T$(Jackpot) and P(1/$N_E$) and (P(Trigger_a)$_E$+P(Trigger_b)$_E$). In one embodiment, $W_E$ is not a function of P(1/$N_E$) and instead the (P(Trigger_a)$_E$+P(Trigger_b)$_E$) is made a function of P(1/$N_E$). Similarly for that embodiment, $W_A$ is not a function of P(1/$N_A$) and instead the (P(Trigger_a)$_A$+P(Trigger_b)$_A$) is made a function of P(1/$N_A$).

The concept of supplementing with the second triggering event 33*b* to obtain equalization of the chance to win the jackpot at any of the betting positions of the linked-together different tables can be made clearer by referring to the below Table 2.

TABLE 2

| Table | No. of Seats | Game Name | Community Event | P(Trigger_a) | P(Trigger_b) = 0.0500 minus P(Trigger_a) | P(Wheel3$_X$)/N Substitute Wheel | P(Win) = $P_T$(Jackpot) |
|---|---|---|---|---|---|---|---|
| A | 7 | ROULETTE | "00" RESULT | 0.0263 | 0.0237 | 0.0001 | 0.00000500 |
| B | 7 | BACCARAT (A) | 4 Card Tie | 0.0357 | 0.0143 | 0.0001 | 0.00000500 |
| C | 7 | BACCARAT (B) | Dai Bac-Any Kill | 0.0278 | 0.0222 | 0.0001 | 0.00000500 |
| D | 6 | BLACKJACK | BUST 26 | 0.03998 | 0.01002 | 0.0001 | 0.00000500 |
| E | 6 | SPANISH 21 | BUST 26 | 0.03444 | 0.01556 | 0.0001 | 0.00000500 |
| F | 6 | PAI GOW | Dealer 9, 10, J or Q High Pai Gow | 0.02571 | 0.02429 | 0.0001 | 0.00000500 |
| G | 6 | POKER-5 CARD | 3 of a Kind + (community cards) | 0.0287 | 0.0222 | 0.0001 | 0.00000500 |
| H | 10 | POKER - CASH GAME | 3 Card Straight-Flop | 0.0348 | 0.0152 | 0.0001 | 0.00000500 |
| X | N | Other | Other with P(Event) < 5% | (35a) | (35b) | P(Wheel3$_X$) divided by $N_X$ | $P_T$(Jackpot) |

In the given example of TABLE 2, the alphabetic table identifications do not necessarily correspond to any of those illustrated in FIG. 1B. Instead they provide useful row numbers for the table. The respective community event triggering probabilities 35*a*$_X$ are each less than five percent (50%) and a decision was made to level up each one of them to 5% by supplementing with a corresponding second triggering event 33*b*$_X$ that has a wheel spin triggering probability equal to 500 minus the respective community event triggering probability 3*a*$_X$. Then each such result is divided by 10,000 to achieve the common target probability $P_T$(Jackpot) of 0.000005 for winning the jackpot as indicated in Table 2. Has further indicated in Table 2, that 1/10,000 factor is actually P(Wheel3$_X$) divided by $N_X$. This accounts for the difference in number of operational betting positions at each of the different tables. The substituted in probability value for winning a jackpot in WHEEL #3 is 1/10,000 multiplied by $N_X$. Of course other target values for (P(Trigger_a)$_X$+P(Trigger_b)$_X$) could have been picked and other target probabilities, $P_T$(Jackpot) could have been picked based on various factors including the portion of each side bet that contributes to the respective jackpot pool and the size (monetary value) of the respective side bet. As seen, the respective weighted-wheel probabilities for the different tables are different and are chosen to coincide with the number N of operational seats at each respective table so that the effective probabilities at each table and for each betting position are the same (are equal to the target probability, $P_T$(Jackpot)).

Figure 1D:
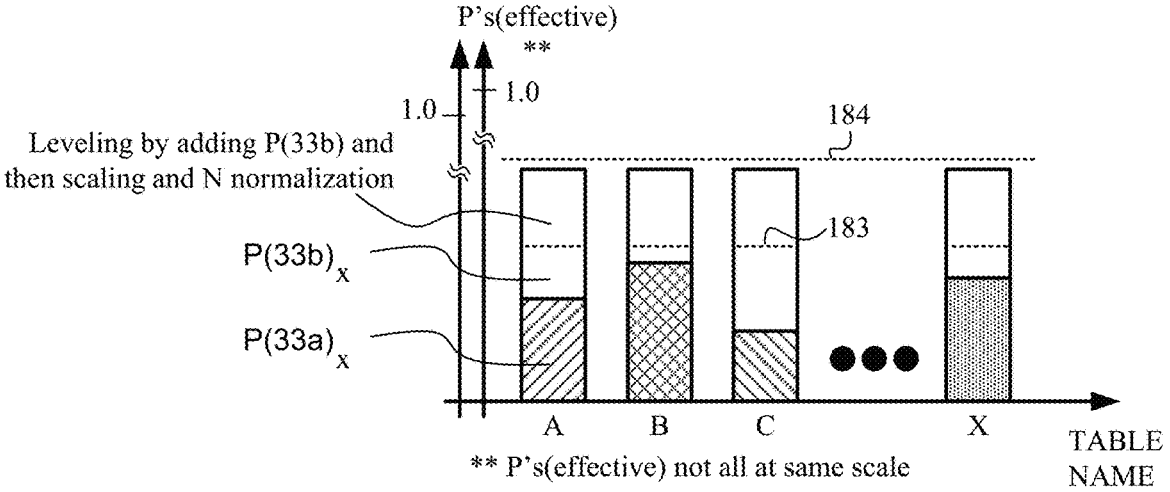
FIG. 1D is a conceptual graph for explaining how probability leveling for winning the jackpot may be achieved in accordance with a second embodiment.

Referring to FIG. 1D, the concept of achieving a same target probability at the different tables with use of the supplemental triggering event 33*b* is graphically illustrated. Again it should be noted that the target probability (level 184) is on the order of about ten thousand times smaller than P(33*a*)$_X$ and P(33*b*)$_X$. The latter two are added to achieve the intermediary level indicated by 183 and then scaling and normalization by multiplying with $N_X$ occurs to obtain, and level 184 (which again, is at a much smaller order of magnitude even though it is shown as being larger). Although above Table 2 and FIG. 1D show the P(33*b*)$_X$ value been picked to achieve the intermediary level indicated by 183 (e.g., 5%), this is not a necessary step. The P(33*b*)$_X$ value could have instead been picked to fully compensate for the difference in the number of operational betting positions $N_X$ at the different tables or to partially compensate for that difference. Many so-called, "hybrid" variations are possible in which the purpose of the supplementing second trigger 33*b* is different than the example given above and/or in which plural supplementing triggers 33*b*, 33*c*, 33*d*, . . . , etc. are used (33*c*, 33*d* not shown but would have their own RNG similar to that shown at 33*b* of FIG. 1A) with each having a respective purpose (e.g., prize opportunity equalization by summing to compensate for one or more of different P(33*a*)$_X$ and $N_X$ at the respectively linked-together tables).

One class of embodiments uses the so-called "Pull Tab" method in accordance with the following. At the boot up of a given gaming table and before any gaming action begins, the dealer is required to specify to the software the number of operational betting positions at that table ($N_X$) and exactly which table game is to be played there where the specified table game implicitly identifies not only the game type (e.g., Roulette, Baccarat, Pai Gow, Blackjack, Criss-Cross Poker, etc.) but also the specific contributions which will be made by placed side bets. More specifically and as an example, if each side bet is fixed to be $5, then the identification of a specific table game may implicitly indicate how that $5 sum is divided for contribution to specific prize pools and/or other destinations. Yet more specifically, a predetermined look up table (LUT) may indicate that for the specified table game, the $5 side bet sum (SB) is to be split as follows: SBa=$0.50 for the Primary meter; SBb=$2.50 to the Reserve Primary Meter; SBc=$0.75 to the House; SBd=$0.25 to the Secondary meter; and SBe=$1.00 to Reserve Secondary Meter.

The same or another co-associated look up table (LUT) will specify for the input number of operational betting positions at that table ($N_X$) and the identified table game, corresponding Pull Tab constructs. More specifically, the following prize constructs (Tables 3 and 4) might be pre-configured for a Roulette Game with 7 operational betting spots and an overall target probability $P_T$(Jackpot #1) of 26 in 20,000 for a primary jackpot, and 106 in 20,000 ($P_T$ (Jackpot #2)) for a secondary jackpot in Table 4:

TABLE 3

| iQ | ValueiQ (for WHEEL#1) Community Prize amount | JiQ (for WHEEL#1) Instances of this Community Prize amount | Probability (approximate) |
|---|---|---|---|
| a | $250 | 200 | 1.00% |
| b | $200 | 300 | 1.50% |
| c | $175 | 400 | 2.00% |
| d | $150 | 800 | 4.00% |
| e | $100 | 1,800 | 9.00% |
| f | $ 80 | 2,400 | 12.00% |
| g | $ 75 | 2,800 | 14.00% |
| h | $ 60 | 3,300 | 16.50% |
| i | $ 50 | 4000 | 20.00% |
| j | $ 50 | 4000 | 20.00% |
| Sum | - - - | 20,000 | 100% |

TABLE 4

| iQ | ValueiQ (for WHEEL#3) Community Prize amount | JiQ (for WHEEL#3) Instances of this Exclusive Prize amount | Probability (approximate) |
|---|---|---|---|
| a | Jackpot #1 | 26 | 0.13% |
| b | Jackpot #2 | 106 | 0.53% |
| c | $1,000 | 300 | 1.50% |
| d | $750 | 800 | 4.00% |
| e | $700 | 1,900 | 9.50% |
| f | $600 | 2,500 | 12.50% |
| g | $500 | 3,200 | 16.00% |
| h | $500 | 3,200 | 16.00% |
| i | $400 | 4,000 | 20.00% |
| j | $400 | 3,968 | 19.84% |
| Sum | - - - | 20,000 | 100% |

In one embodiment, the dealer controls include a 'Spin Triggered' Button. The dealer terminal does not have an input for the type of hand in which a community prize spin (WHEEL #1) will be triggered. The type of community event is implied by the game specified. For example, in a Poker game it could be one of the players getting three of a kind or better. In other words, for this example the system does not differentiate between three of a kind or a four of a kind—it only knows that a triggering event occurred (YES or NO) because the dealer hand triggered the event occurrence using the 'Spin Triggered' Button. In one embodiment the community triggering event will be clearly stated on the layout markers 30 next to the bet sensors 100.

Figure 4A:
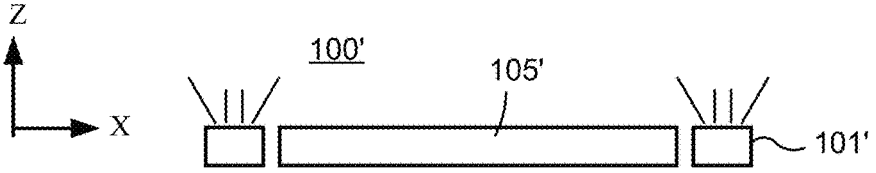
FIG. 4A illustrates an input receiving device having an associated indicator in accordance with one embodiment.
Figure 4B:
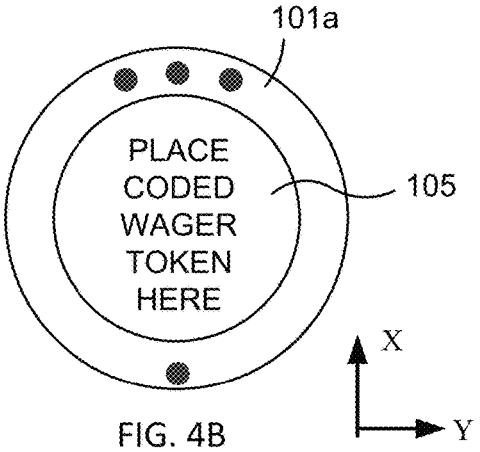
FIGS. 4B-4E illustrate some controller established states for the input receiving device of FIG. 4A.
Figure 4C:
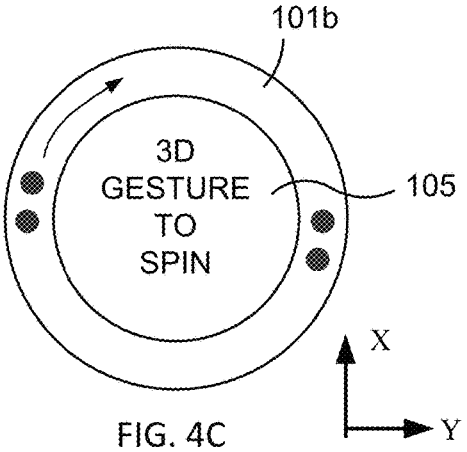
Figure 4D:
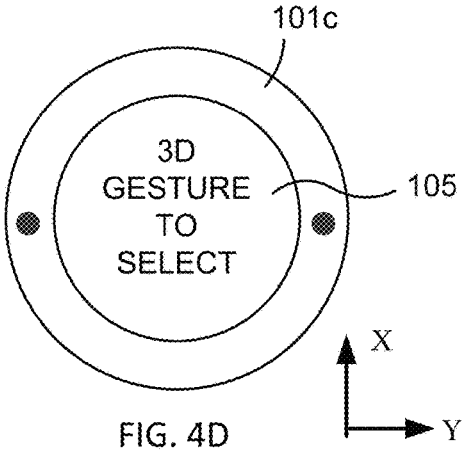
Figure 4E:
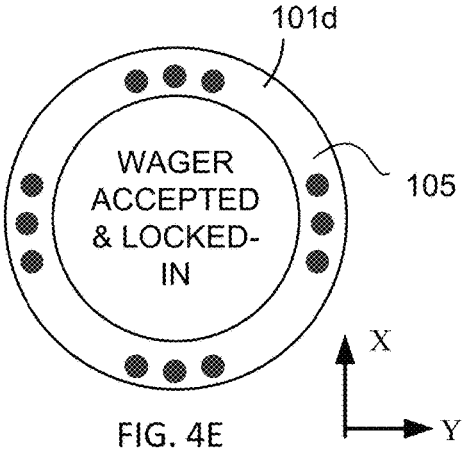

Referring next to FIG. 4A, a schematic for one embodiment of the sensor 100' is illustrated. A ring of visible light emitters (e.g., RGB ones) is provided on a planer circuit board (PCB not shown) to be substantially coplanar with a proximity detector 105'. The combination is driven by software executing in the table controller 1000. FIG. 4B shows a state where the light emitters in the ring 101*a* are lit in a first pattern (e.g., blinking from having one dot on the bottom to a plurality on the top and then pausing between repeats to indicate an arrow direction), where the light pattern is part of a messaging to the player that a timeslot is now open for placing a coded wager token over the center 105 of the sensor 100. FIG. 4C shows a second state where the light emitters in ring 101*b* are lit as a circulating second pattern and as part of a second messaging to the player that a timeslot is now open for the player to manually initiate the spin of an indicated wheel of chance. FIG. 4D shows a third state where the light emitters in ring 101*c* are lit as a horizontally alternating pattern to indicate to the player that a timeslot is now open for the player to move a hand either left or right or right to left over the sensor center 105 for moving a cursor on the screen 36 in a corresponding direction for selecting an available menu option (not shown). FIG. 4E shows a fourth state where the light emitters in ring 101*d* are lit as a fixed steady pattern to indicate to the player that his or her recently placed wager (now removed by the dealer) has been accepted and locked-in for the upcoming round of gaming action.

Figure 5:
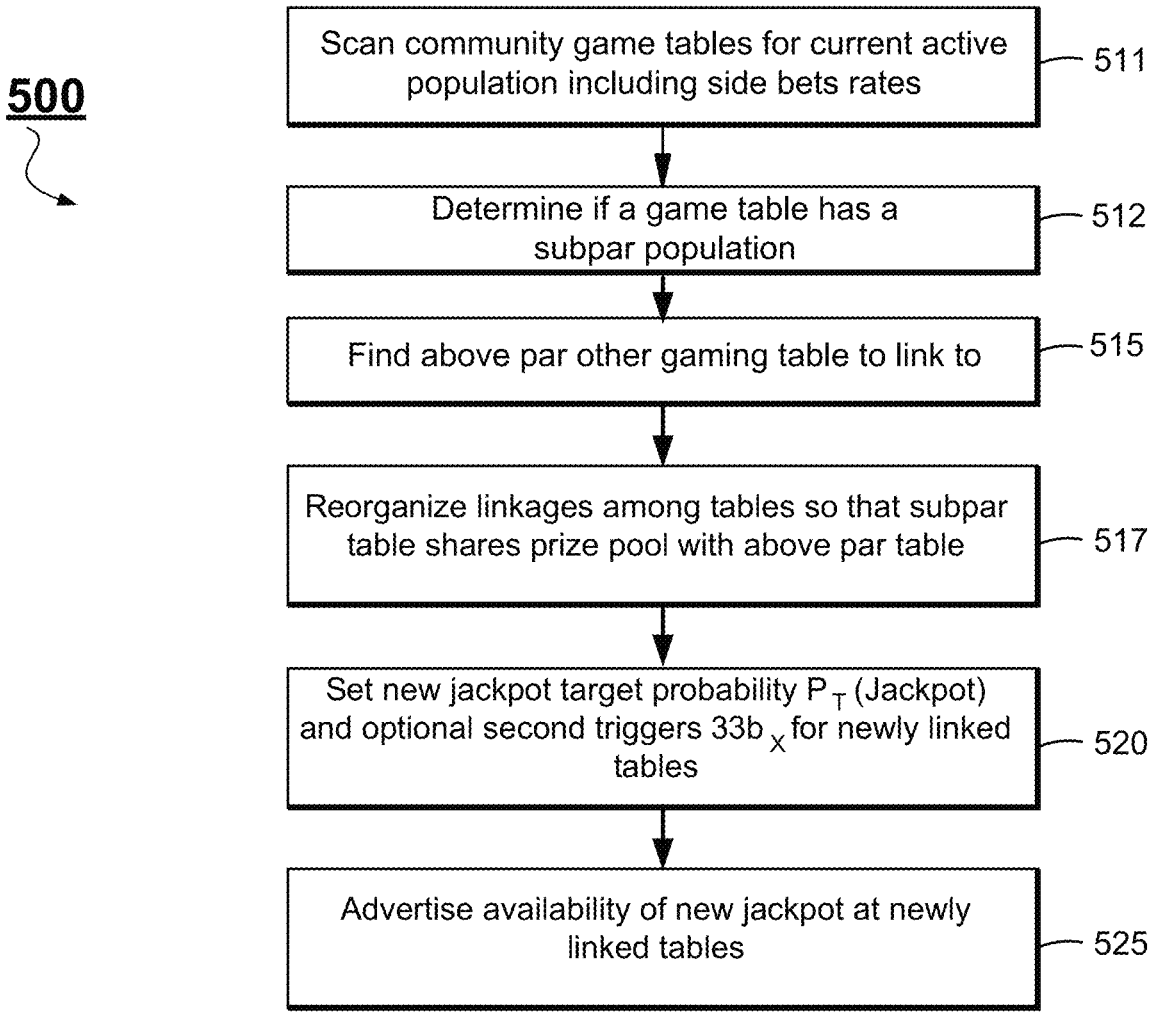
FIG. 5 is a process flow diagram which illustrates a casino floor scanning method and table linking method in accordance with an embodiment.

Referring to FIG. 5, shown is a machine-automated implemented method 500 (e.g., executed by a central server in cooperation with respective table controllers 1000 at respective tables) for scanning the casino floor for the level of gaming action at various ones of different gaming tables that offer community prizes. In step 511, the process polls each of the available community game tables for information about their respective population of currently active players and the rates at which those players have recently been placing side bets. In step 512, the process determines whether there is a game table among the responding tables that is showing subpar performance relative to predetermined thresholds. In step 515, the process determines whether there is a game table among the responding tables that is showing and above par performance with respect to number of active players, number of active betting positions and recent rates of side bet placement. At step 517, the process reorganizes the linkages between the tables and corresponding prize pools (e.g., jackpot pools) so that the subpar table will be sharing a prize pool with the found above-par table. In step 520 a new jackpot target probability $P_T$(Jackpot) that is to be common to all the active players of the newly linked tables is determined. If optional second triggers 33*b* are to be used, those are also determined for the newly linked tables. In step 525, a loudspeaker and/or other form of advertisement is presented to players and bystanders in the affected area of the casino where the new linkages have been made advising them of the availability of a new jackpot prize at the newly linked tables.

Figure 6:
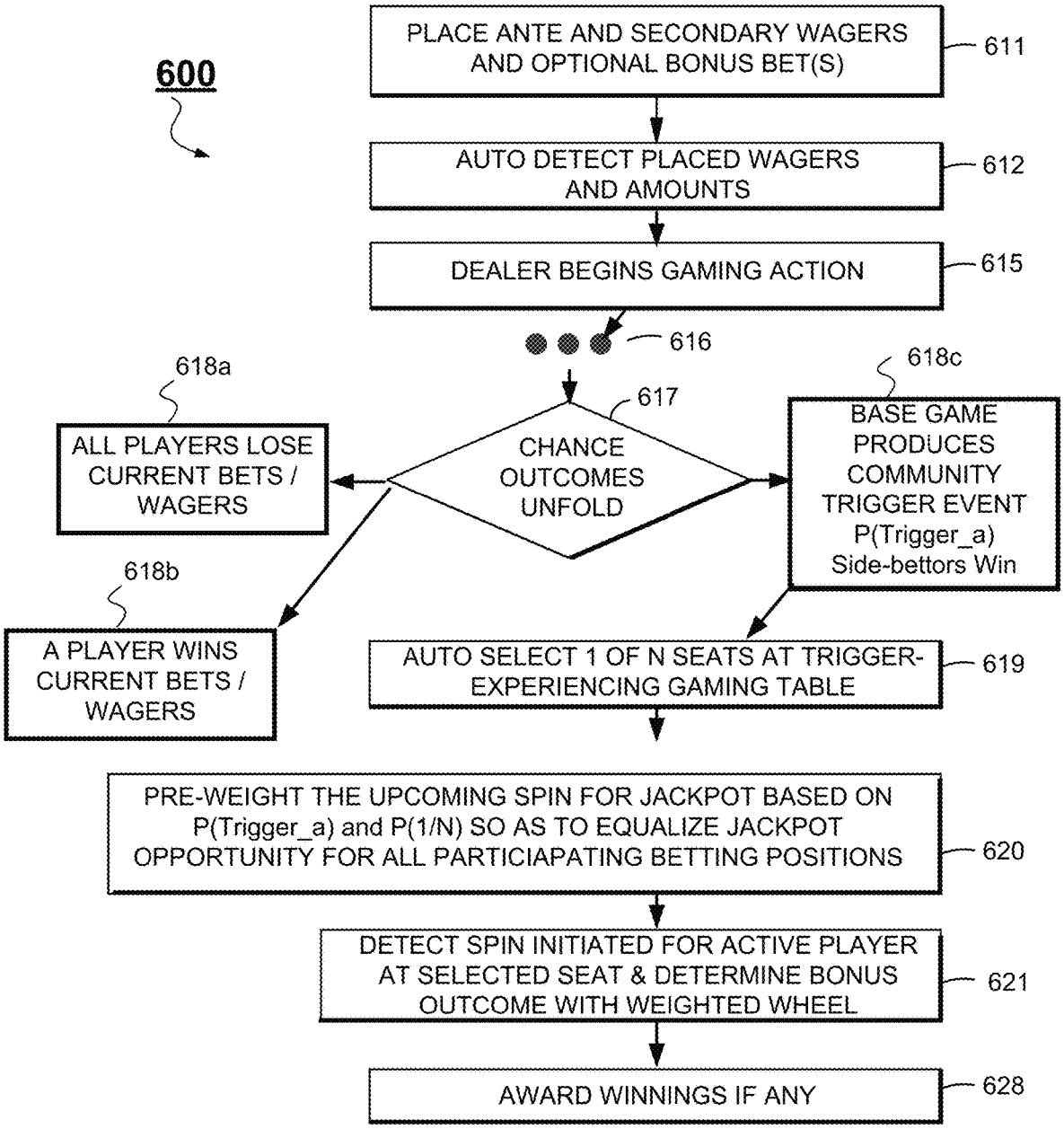
FIG. 6 is a process flow diagram which illustrates embodiments of presenting and playing games in accordance with one aspect of the present disclosure of invention.

Referring to FIG. 6, shown is a machine-automated implemented method 600 (e.g., executed by a central server in cooperation with respective table controllers 1000 at respective tables) for providing a chance to win a multi-table jackpot prize when a community event trigger 33$a_X$ occurs at one of plural game tables A, B, C, . . . X contributing to a shared jackpot pool (e.g., 168*a*). Step 611 represents the placement of a side bet on a corresponding community event at a respective betting position (e.g., A2) of one of the linked together tables A, B, C, . . . X. Step 612 represents the automatic detection that a side bet of a predetermined proper amount (same for all the linked together tables A, B, C, . . . X) has been placed, accepted and locked-in.

At step 615, the ability to place further side bets is blocked and the dealer begins the current round of gaming action. Step 616 represents the carrying out over time of events within the core game (e.g., cards dealt out; Roulette ball is spinning, etc.) At step 617 the final chance outcomes of the core gaming activity are revealed. One of the possible outcomes is that all players lose their current bets and wagers as indicated in block 618*a*. Another of the possible outcomes is that one of the players wins his or her current bets and wagers relating to the core gaming action as indicated in block 618*b*. Yet another of the possible outcomes is that the core game produces a community trigger event 33 having a probability of occurrence of P(Trigger_a). This possibility as indicated in block 618*c*. One of the results is that all side bettors who bet on that occurrence of the community trigger event 33 when a predetermined prize. Another possibility is that WHEEL #1 (36*a* of FIG. 1A) is displayed as spinning and the side bettors wait for its outcome (e.g., bigger or smaller community prizes).

At the same time and in one embodiment, WHEEL #2 (36*c* of FIG. 1A) is displayed as spinning and the side bettors wait for its outcome for determining which of them, if any, is sitting in the lucky one of the N operational betting positions available at the trigger-experiencing gaming table. This is represented by block 619 of FIG. 6.

At the same time and in one embodiment, WHEEL #3 (36*e* of FIG. 1A) is displayed as spinning and the side bettors wait for its outcome for determining what the exclusive prize amount will be for the lucky betting position determined by WHEEL #2. Before or while WHEEL #3 is spinning, appropriate probability weights are assigned to the predetermined outcome slices of that WHEEL #3 so that all side bet placing players at not only the trigger-event experiencing table will have had a same chance for exclusively winning the jackpot pool prize (e.g., 168*a*) but also all the side bet placing players at all the other gaming tables that contribute to the multi-table jackpot pool (e.g., 168*a*) will have had the same chance for exclusively winning the jackpot pool prize. This is done by accounting for the different probabilities $P(Trigger_a)_X$ of the respective trigger event at each respective game table X and for the respective number of operational betting positions $N_X$ at each respective one of the linked together gaming tables. At step 621 the final outcome for the spun WHEEL #3 is revealed, the final outcome for the spun WHEEL #2 is revealed, and then in step 628 and exclusive payout is made to the side bettor if any, at the picked one out of N betting positions. As mentioned above, the excitement experienced at the table is heightened when the multi-table jackpot pool amount has grown to a relatively large amount (e.g., $10,000 or more) and the final outcome for the spun WHEEL #3 is revealed as being that large amount before the final outcome for the spun WHEEL #2 is revealed.

Figure 7:
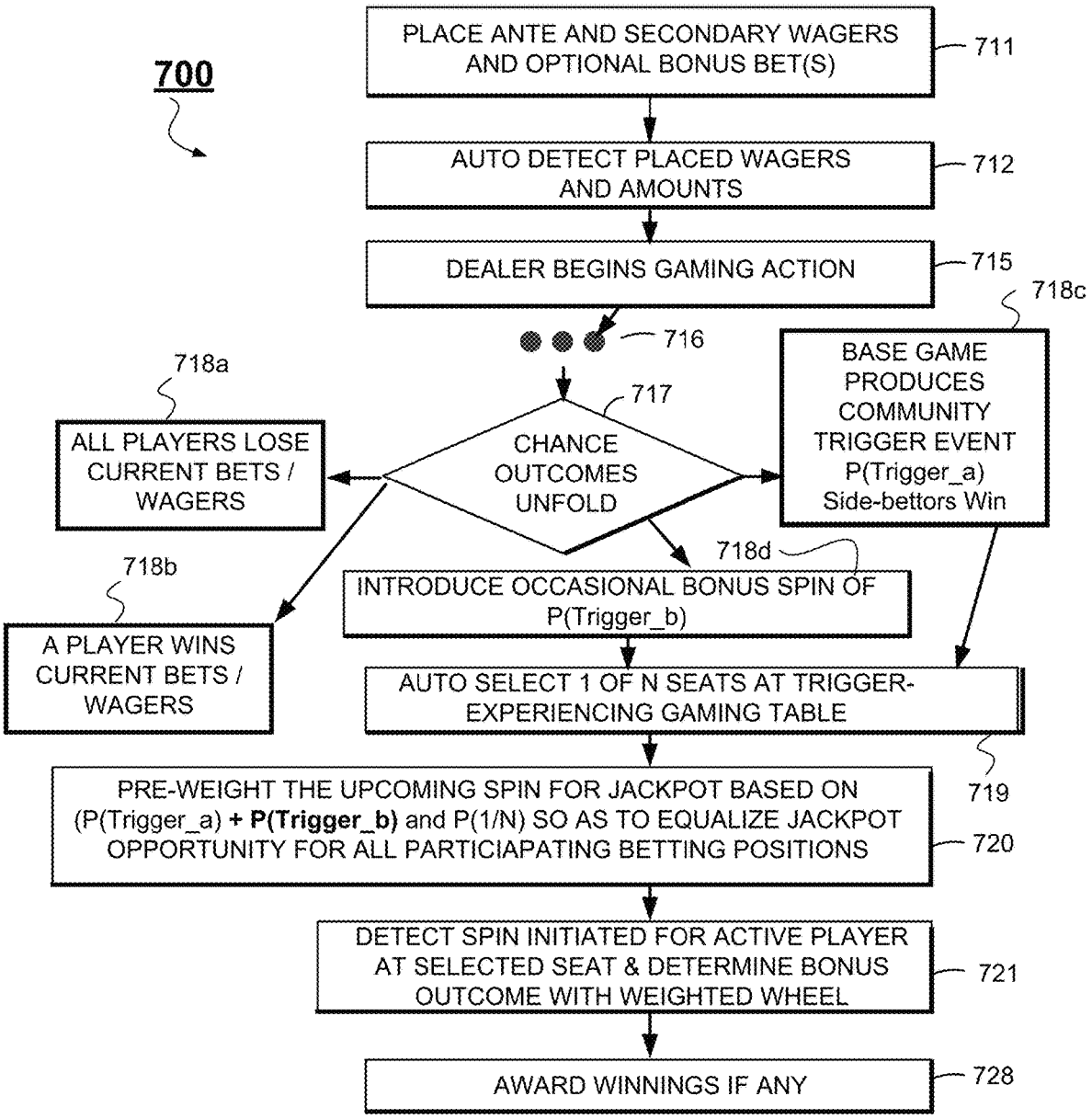
FIG. 7 is a process flow diagram which illustrates embodiments of presenting and playing games in accordance with a second aspect of the present disclosure of invention.

Referring to FIG. 7, shown is a machine-automated implemented method 700 (e.g., executed by a central server in cooperation with respective table controllers 1000 at respective tables) for providing a chance to win a multi-table jackpot prize when a community event trigger $\mathbf{33}a_X$ occurs at one of plural game tables A, B, C, . . . X contributing to a shared jackpot pool (e.g., 168*a*) and where the community event trigger $\mathbf{33}a_X$ is not the only means for triggering the spinning of the corresponding WHEEL #3 (36*e*) but rather there is a second trigger $\mathbf{33}b_X$ that occurs at a predetermined frequency for supplementing the community event trigger $\mathbf{33}a_X$. The blocks in FIG. 7 are numbered in the 700 century range and generally correspond to similar blocks found in FIG. 6 but numbered in the 600 century range. Accordingly repeated description is not needed for most of the blocks in FIG. 7. The exceptions are that there is an additional block 718*d* which occasionally introduces a bonus spin (e.g., free spin) at a frequency and with probability of success that produces the P(Trigger_b) factor. (Said factor is the product of the reciprocal of the frequency of appearance of the bonus spin wheel (not shown) and the probability that the spinning of that bonus spin wheel will lead to a spinning of WHEEL #3 and thus an opportunity for winning the big jackpot or another significant award.) Additionally, block 720 is different than counterpart 620 in that the community event probability P(Trigger_a) and the introduced bonus spin probability P(Trigger_b) are added together as part of the process for equalizing the opportunity at each betting position of each of all the linked together tables for winning the correspondingly shared multi-table jackpot pool prize (e.g., 168*a* or 168*b*).

Further variations will of course become apparent to those skilled in the art after studying the present disclosure. For example, rather than having just one bonus spin wheel appearing at a given first frequency to effectuate the P(Trigger_b) probability factor, one could have additional bonus spin wheels appearing at respective other frequencies to effectuate additional P(Trigger_c), P(Trigger_d), etc. probability factors where block 720 will then show the sum as including these additional probability factors. The displayed additional bonus spin wheels (not shown) can be different in appearance and/or offered probabilities from the first bonus spin wheel so as to give players a sense of variety.

Because physical instantiations of signals representing information and program instructions may be employed to implement the systems/methods described herein, the present disclosure of invention relates to tangible (non-transitory) machine readable media that include program instructions, state information, etc. for performing various operations described herein. Examples of machine-readable media include hard disks, floppy disks, magnetic tape, optical media such as CD-ROM disks and DVDs; magneto-optical media such as optical disks, and hardware devices that are specially configured to store and perform program instructions, such as read-only memory devices (ROM) and programmable read-only memory devices (PROMs). Examples of program instructions include both machine code, such as produced by a compiler, and files containing higher level code that may be executed by the computer using an interpreter.

Although many of the components and processes are described above in the singular for convenience, it will be appreciated by one of skill in the art that multiple components and repeated processes can also be used to practice the techniques of the present disclosure.

While the present disclosure of invention has been particularly shown and described with reference to specific embodiments thereof, it will be understood by those skilled in the art that changes in the form and details of the disclosed embodiments may be made without departing from the spirit or scope of the present teachings. It is therefore intended that the disclosure be interpreted to include all variations and equivalents that fall within the true spirit and scope of the present teachings.

What is claimed is:

1. A method of awarding a multi-table progressive prize to a plurality of gaming tables comprising:

detecting, via one or more input devices, one or more side bets placed on one or more betting positions on said plurality of gaming tables, said input device in communication with a table controller comprising machine readable code stored in a memory and executed by a processor, said side bet associated with a community event at said one or more of said plurality of gaming tables;

establishing, via said table controller, a target probability for the receipt of said progressive prize for each of said betting positions relative to said one or more side bets;

generating, via said table controller, a probability of occurrence of the receipt of said progressive prize for each of said betting positions at which said one or more side bets have been placed;

generating, via said table controller, an adjustment to the probability of occurrence for each of said betting positions so that an adjusted probability of occurrence at each of said one or more betting positions at which said one or more side bets have been placed equals said target probability;

graphically displaying, via a display device, a random selection of a winning position from said one or more betting positions, said random selection adjusted by said adjustment; and graphically displaying, via said display device; an award of said multi-table progressive prize to said winning betting position.

2. The method of claim 1, wherein:

upon the occurrence of a second community event at one of said plurality of gaming tables, a second prize is awarded to said one or more betting positions at said one of said plurality of gaming tables.

3. The method of claim 2, wherein:

the amount of said second prize is determined by a graphic display on said display device of a selection of a segment on a first wheel of chance comprising a plurality of segments.

4. The method of claim 3, wherein:

said one or more betting positions on said plurality of gaming tables are determined by a graphic display on said display device of a selection of a segment on a second wheel of chance comprising a plurality of segments.

5. The method of claim 4 further comprising:

awarding an enhanced prize to one of said one or more betting positions, said award of said enhanced prize determined by a graphic display on said display device of a selection of a segment on a third wheel of chance comprising a plurality of segments.

6. The method of claim 5, wherein:

said selection of said segment on said thee-third wheel of chance occurs after said selection of said segment on said second wheel of chance.

7. The method of claim 1, wherein:

said plurality of gaming tables comprising at least two of the following a Blackjack gaming table, a Spanish 21 gaming table, a Poker gaming table, a Baccarat gaming table, a Roulette gaming table, a Craps gaming table, and a Pai Go gaming table.

8. The method of claim 1, wherein:

said one or more input devices comprises: a proximity sensor configured to detect placement of a wager-representing token near said proximity sensor; and a plurality of visible light emitters surrounding the proximity sensor, said plurality of visible light emitters configured to indicate different states of readiness of one or more input devices for receiving wager-representing tokens.

9. The method of claim 4, wherein:

said selection of said segment on said second wheel of chance occurs after said selection of said segment on said first wheel of chance.

10. The method of claim 4 further comprising:

upon said determination of said one or more betting positions by the selection of said segment on said second wheel of chance, activating an indicator associated with said one or more betting positions.

11. A machine system to award a multi-table progressive prize to a plurality of gaming tables comprising:

said plurality of gaming tables comprising one or more betting positions;

an input device configured to detect one or more side bets placed on said one or more betting positions;

a display device; and a table controller comprising a memory, machine readable code stored in said memory, and a processor executing said machine readable code to:

establish a target probability for the receipt of said progressive prize for each of said betting positions relative to said one or more side bets;

generate a probability of occurrence of the receipt of said progressive prize for each of said betting positions at which said one or more side bets have been placed;

generate an adjustment to the probability of occurrence for each of said betting positions so that an adjusted probability of occurrence at each of said one or more betting positions at which said one or more side bets have been placed equals said target probability;

cause said display device to graphically display a random selection of a winning position from said one or more betting positions, said random selection adjusted by said adjustment; and cause said display device to graphically display an award of said multi-table progressive prize to said winning betting position.

12. The machine system of claim 11 wherein said processor executing said machine readable code to further award a community prize, upon the occurrence of a community event at one of said plurality of gaming tables, said community prize awarded to said one or more betting positions at said one of said plurality of gaming tables.

13. The machine system of claim 12, wherein:

the amount of said community prize is determined by a graphic display on said display device of a selection of a segment on a first wheel of chance comprising a plurality of segments.

14. The machine system of claim 12, wherein:

said one or more betting positions on said plurality of gaming tables are determined by a graphic display on said display device of a selection of a segment on a second wheel of chance comprising a plurality of segnents.

15. The machine system of claim 14 wherein said processor executing said machine readable code to further award an enhanced prize to said one or more betting positions, said award of said enhanced prize determined by a graphic display on said display device of a selection of a segment on a third wheel of chance comprising a plurality of segments.

16. The machine system of claim 15, wherein:

said selection of said segment on said third wheel of chance occurring after said selection of said segment on said second wheel of chance.

17. The system of claim 14, wherein:

said selection of said segment on said second wheel of chance occurs after said selection of said segment on said first wheel of chance.

18. The system of claim 14 wherein said processor executing said machine readable code to further:

upon said determination of said one or more betting positions by the selection of said segment on said second wheel of chance, activate an indicator associated with said one or more betting positions.

19. A method of awarding a multi-table progressive prize comprising:

when a community event occurs, activating, via a table controller comprising machine readable code stored in a memory and executed by a processor, a plurality of input devices at a plurality of betting positions on a plurality of gaming tables;

detecting, via said plurality of input devices, side bets placed at one or more of said plurality of betting positions;

activating, via a display device, a graphic display of a first wheel of chance comprising a plurality of segments; said plurality of segments of said first wheel representing a plurality of amounts for a first prize;

activating, via said display device, a graphic display of a selection of one of said plurality of segments of said first wheel of chance to award said first prize to said one or more of said plurality of betting positions receiving said side bets;

activating, via said display device, a graphic display of a second wheel of chance comprising a plurality of segments; said plurality of segments of said second wheel representing said one or more of said plurality of betting positions receiving said side bets;

activating, via said display device, a graphic display of a selection of one of said plurality of segments of said second wheel of chance to designate a winning betting position, said selection of said winning betting position comprising a random selection adjusted by an adjustment to a probability of occurrence for each of said betting positions so that an adjusted probability of occurrence at each of said one or more betting positions at which said side bets have been placed equals said target probability, said target probability established for said progressive prize for each of said betting positions relative to said side bets, said probability of occurrence generated relative to the receipt of said progressive prize for each of said betting positions at which said side bets have been placed relative to said one or more betting positions and said target probability;

causing said display device to graphically display a random selection of a winning position from said one or more betting positions, said random selection adjusted by said adjustment;

activating, via said display device, a graphic display of a third wheel of chance comprising a plurality of segments; said plurality of segments of said third wheel representing a plurality of amounts for an enhanced prize; and activating, via said display device, a graphic display of a selection of one of said plurality of segments of said third wheel of chance to award said enhanced prize to said winning position.

20. The method of claim 19 wherein said plurality of input devices are configured to detect side bets placed via physical gaming chips or a player's hand gesture.

* * * * *